US012264892B2

(12) United States Patent
Smith et al.

(10) Patent No.: US 12,264,892 B2
(45) Date of Patent: Apr. 1, 2025

(54) ELECTRIFIED BATON

(71) Applicant: Axon Enterprise, Inc., Scottsdale, AZ (US)

(72) Inventors: Patrick W Smith, Scottsdale, AZ (US); Lynn Kern, Phoenix, AZ (US); Mark Eastwood, Scottsdale, AZ (US); Hans Moritz, Scottsdale, AZ (US); Nathan Patulski, Scottsdale, AZ (US); Brian Fairbanks, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 778 days.

(21) Appl. No.: 17/068,790

(22) Filed: Oct. 12, 2020

(65) Prior Publication Data

US 2021/0108883 A1 Apr. 15, 2021

Related U.S. Application Data

(60) Provisional application No. 62/914,248, filed on Oct. 11, 2019.

(51) Int. Cl.
*F41B 15/04* (2006.01)
*F41B 15/02* (2006.01)

(52) U.S. Cl.
CPC ..... *F41B 15/04* (2013.01); *F41B 15/02* (2013.01)

(58) Field of Classification Search
CPC ..... F41B 15/02; F41B 15/04
USPC ..... 273/84
See application file for complete search history.

(56) References Cited

U.S. PATENT DOCUMENTS

2009/0039145 A1* 2/2009 Andersen ..... A01K 15/029 231/7
2014/0240890 A1* 8/2014 Bradshaw ..... A01M 29/16 361/232

* cited by examiner

*Primary Examiner* — Michael C Grant
(74) *Attorney, Agent, or Firm* — H S. Malvich, Jr.; Andrew Graham

(57) ABSTRACT

An electrical weapon may include a shaft, an arm, first electrode, and a second electrode. The arm may be pivotably coupled to the shaft and the first electrode may be coupled to the arm such that a position of the electrode changes in accordance with a change in position of the arm. The electrical weapon may be an electrified baton. The electrical weapon may further include a second arm pivotably coupled to the shaft. The second electrode may be coupled to the second arm. The electrical weapon may enable a stimulus signal to be applied via the electrodes at a distance from a user of the electrical weapon, thus improving safety of the user. An electrode may include an electrode array comprising a plurality of conductors and a stimulus signal may be conducted between pairs of the conductors via ionization of air between the conductors.

19 Claims, 5 Drawing Sheets

ELECTRIFIED BATON

FIELD OF THE INVENTION

Embodiments of the present disclosure relate to an electrical weapon. Particularly, embodiments include an electrified baton and an electrode array for an electrical weapon.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers may refer to similar elements and steps throughout the figures.

Figure 1:
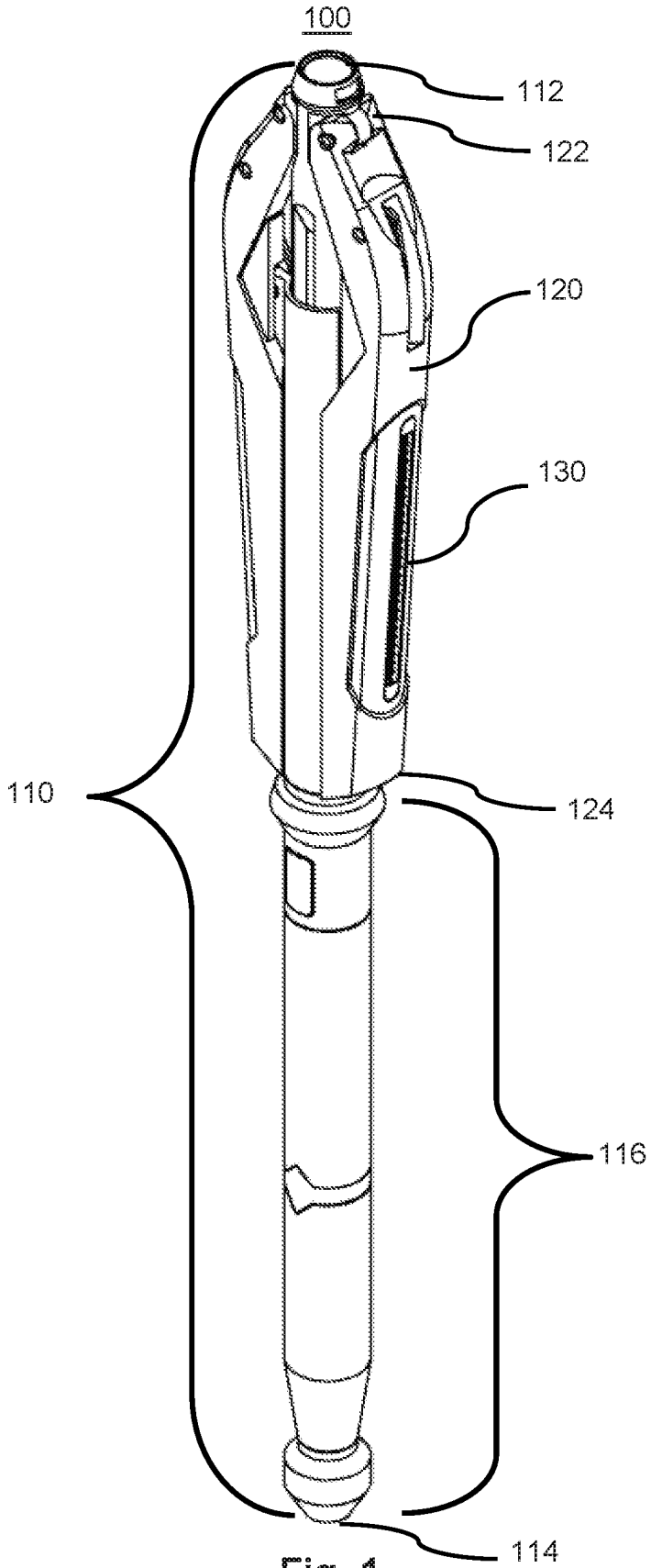
FIG. 1 illustrates a perspective view of an electrical weapon in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Additionally, any reference to without contact (or similar phrases) may also include reduced contact or minimal contact. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, an electrical weapon may be used to deliver a current (e.g., stimulus signal, pulses of current, pulses of charge, etc.) through tissue of a human or animal target. The stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion by the target.

A stimulus signal may be delivered through the target via electrodes coupled to the electrical weapon. Delivery via the electrodes may be referred to as a local delivery (e.g., a local stun). During local delivery, the electrodes are brought close to the target by positioning the electrical weapon proximate to the target. The stimulus signal is delivered through the target's tissue (e.g., target tissue) via the electrodes. To provide local delivery, a user of the electrical weapon may be positioned within arm's reach of the target and may bring the electrodes of the electrical weapon into contact with or proximate to the target.

Electrodes that contact or are proximate to the target tissue deliver the stimulus signal through the target. Contact of an electrode with the target tissue establishes an electrical coupling (e.g., circuit) with the target tissue. An electrode may include a spear that may pierce clothing and/or tissue of the target to contact the target. An electrode that is proximate to the target tissue may use ionization to establish an electrical coupling with the target tissue. Ionization may also be referred to as arcing.

In use (e.g., during deployment), an electrode may be separated from target tissue by the target's clothing or a gap of air. In various embodiments, a signal generator of the electrical weapon may provide the stimulus signal (e.g., current, pulses of current, etc.) at a high voltage (e.g., in the range of 40,000 to 100,000 volts) to ionize the air in the clothing or the air in the gap that separates the electrode from the target tissue. Ionizing the air establishes a low impedance ionization path from the electrode to the target tissue that may be used to deliver the stimulus signal into the target tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the electrode is no longer electrically coupled to the target tissue. Lacking the ionization path, the impedance between the electrode and target tissue is high. A high voltage in the range of about 50,000 volts can ionize air in a gap of up to about one inch.

An electrical weapon may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode and a target to electrically couple the electrode to the target. In response to the electrode being electrically coupled to the target, the low voltage portion of the pulse delivers an amount of charge into the target tissue via the ionization path. In response to the electrode being electrically coupled to the target by contact (e.g., touching, spear embedded into tissue, etc.), the high portion of the pulse and the low portion of the pulse both deliver charge to the target tissue. Generally, the low voltage portion of the pulse delivers a majority of the charge of the pulse into the target tissue. In various embodiments, the high voltage portion of a pulse of the stimulus signal may be referred to as the spark or ionization portion. The low voltage portion of a pulse may be referred to as the muscle portion.

In various embodiments, a signal generator of the electrical weapon may provide the stimulus signal (e.g., current, pulses of current, etc.) at only a low voltage (e.g., less than 2,000 volts). The low voltage stimulus signal may not ionize the air in the clothing or the air in the gap that separates the electrode from the target tissue. A CEW having a signal generator providing stimulus signals at only a low voltage (e.g., a low voltage signal generator) may require electrodes to be electrically coupled to the target by contact (e.g., touching, spear embedded into tissue, etc.).

In various embodiments, an electrical weapon may include at least two electrodes on one or more surfaces of one or more housings of the electrical weapon. The electrodes may be spaced apart from each other. High voltage of a stimulus signal impressed across the electrodes may result in ionization of the air between the electrodes. The arc between the electrodes may be visible to the naked eye. Current that may have been provided via the electrodes to a target may arc across the one or more surfaces of the electrical weapon via the electrodes.

A likelihood that a stimulus signal will cause NMI increases when electrodes that deliver the stimulus signal are spaced apart at least 6 inches (15.24 centimeters) so that the current from the stimulus signal flows through 6 or more inches of the target tissue. The likelihood of a stimulus signal causing NMI increases as a distance between electrodes that deliver the stimulus signal increases. In various embodiments, the electrodes are preferably spaced apart by at least 12 inches (30.48 centimeters) on the target. When electrodes on an electrical weapon are less than 6 inches apart, a stimulus signal delivered through the target tissue via such electrodes likely may not cause NMI, only pain.

A series of pulses may include two or more pulses separated in time. Each pulse delivers an amount of charge into target tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, an electrical weapon may be hand-held and use batteries to provide the pulses of the stimulus signal. In response to the amount of charge per pulse being high and the pulse rate being high, the electrical weapon may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per pulse being about 63 microcoulombs. Empirical testing has shown that a pulse rate of 22 pps and 63 microcoulombs per pulse via a pair of electrodes will induce NMI when the electrode spacing is about 12 inches (30.48 centimeters).

To improve safety of a user of an electrical weapon, it may be desirable to maximize a distance between a target and the user that still allows the electrical weapon to contact or be placed proximate the target. Such a distance decreases likelihood that a target will be able to make contact with the user of the electrical weapon, potentially causing injury of the user. Maximizing this distance may be particularly useful in situations involving multiple potential targets, where a user may need to track and maintain a safe, minimum distance relative to multiple targets.

To improve versatility of an electrical weapon, it may also be desirable for the user to be able to apply a physical force to a target. The electrical weapon may include one or more non-electrified surfaces by which the physical force may be provided, including one or more extended surfaces by which an amount or range of the physical force may be increased or otherwise maximized. By providing a physical force, a user may be able to employ techniques to de-escalate an incident using techniques learned in the context of non-electrical defensive weapons, such as batons. The physical force may be provided as part of a defensive maneuver by a user in the event that an electrical function of the electrical weapon is rendered unusable or ineffective for a given incident.

To improve effectiveness of an electrical weapon, it may also be desirable to provide a stimulus signal via from multiple surfaces of the electrical weapon. By providing the stimulus signal via the multiple surfaces, angles or orientations in which the electrical weapon may be applied to a target may be increased. Ionization of air via a stimulus signal across multiple surfaces of an electrical weapon may also provide a visual warning to a target and discourage physical approach by the target toward a user of the electrical weapon.

To improve likelihood of inducing NMI, it may also be desirable for an electrical weapon to include electrodes separated by a predetermined distance. The distance may be achieved or surpassed by an electrical weapon that selectively positions the electrodes to at least the predetermined distance when the electrical weapon is being used. Selective positioning of the electrodes to distances that do and do not exceed the predetermined distance may enable a size of the electrical weapon to be minimized during periods of non-use of the electrical weapon, including transport of the electrical weapon. Preferably, an electrical weapon may enable a stimulus signal to be provided when electrodes of the electrical weapon both are and are not disposed apart by the pre-determined distance.

Embodiments according to various aspects of the present disclosure address various issues, including one or more of the problems highlighted above. Embodiments according to various aspects of the present disclosure further provide various improvements, including the one or more benefits of safety, versatility, and effectiveness discussed above.

In various embodiments, an electrical weapon for applying a stimulus signal to a target is provided. The electrical weapon may comprise a signal generator configured to generate the stimulus signal, a shaft, a first arm pivotably coupled to the shaft, a first electrode positioned on the first arm, and a second electrode, wherein the first electrode and second electrode are electrically coupled to the signal generator to receive the stimulus signal. The electrical weapon may further comprise a second arm pivotably coupled to the shaft, wherein the second electrode is positioned on the second arm. The first arm may further include a third electrode electrically coupled to the signal generator and the second arm may further include a fourth electrode electrically coupled to the signal generator. The first electrode may be positioned at a first end of the first arm opposite a second end of the first arm by which the first arm is pivotably coupled to the shaft. The second electrode may be positioned at a first end of the second arm opposite a second end of the second arm by which the second arm is pivotably coupled to the shaft. The first arm and second arm may each be configured to rotate to a respective first position at which the first electrode is spaced apart from the second electrode by a second distance of less than four inches. The first arm and second arm may each be configured to rotate to a respective second position at which the first electrode is spaced apart from the second electrode by a first distance of at least six inches. The electrical weapon may further comprise an joint configured to rotate the first arm between a first position relative to the shaft and a second position relative to the shaft, wherein a second distance between the shaft and the first electrode may be greater in the second position than a first distance between the shaft and the first electrode in the first position. The signal generator may be configured to provide the stimulus signal to the first electrode and the second electrode when the first arm is rotated to the first position and when the first arm is rotated to the second position. The joint may comprise a first hinge coupling the first arm to a first housing of the shaft and a second hinge coupling the first arm to a second housing of the shaft, such that movement of the second housing relative to the first housing causes the first arm to rotate relative to the second housing. The second housing may be configured to move linearly relative to the first housing and the first hinge and the second hinge may be configured to translate the linear movement into rotational motion of the first arm relative to the second housing. The first electrode may include an electrode array. The electrode array may comprise a first conductor coupled to the signal generator, a second conductor coupled to the signal generator, and at least one intermediate conductor positioned between the first conductor and the second conductor. The signal generator may be configured to provide the stimulus signal to the at least one intermediate conductor via the first conductor and the second conductor. The electrode array may be disposed along an axis coplanar with a central axis of the shaft. The electrical weapon may further comprise a third electrode positioned on one of the shaft and the first arm. The first arm may be configured to rotate the first electrode through an angle greater than ninety degrees relative to a central axis of the shaft.

In various embodiments, an electrified baton is provided. The electrified baton may comprise an elongated housing including a distal end opposite a proximal end and a first arm may include a first electrode and a first pivot end opposite a first contact end, wherein the first pivot end may be rotationally coupled to the distal end of the elongated housing, thereby enabling the first electrode to rotate between a first position of the first arm and a second position of the first arm. The first electrode may include an electrode array comprising a first conductor, a second conductor, and at least one intermediate conductor positioned between the first conductor and the second conductor, wherein the at least one intermediate conductor is configured to electrically couple a stimulus signal via an electrical discharge in air to each of the first conductor and the second conductor. The first electrode may be positioned at the first contact end of the first arm. The electrified baton may further comprise a handle disposed at the proximal end of the elongated housing. The electrified baton may further comprise a second arm. The second arm may include a second electrode and a second pivot end opposite a second contact end, wherein the second pivot end of the second arm is rotationally coupled to the distal end of the elongated housing, thereby enabling the second electrode to rotate between a first position of the second arm and a second position of the second arm.

In various embodiments, an electrode array for an electrified baton is provided. The electrode array may comprise a first conductor configured to receive a stimulus signal, a second conductor, and at least one intermediate conductor positioned along a linear axis between the first conductor and the second conductor, wherein the at least one intermediate conductor is configured to provide the stimulus signal from the first conductor to the second conductor via an electrical discharge in air between the first conductor and the at least one intermediate conductor and between the at least one intermediate conductor and the second conductor. The at least one intermediate conductor may include at least three ungrounded conductors. The first conductor may be positioned at least three inches away from the second conductor. The at least one intermediate conductor may comprise a plurality of conductors positioned along a distance of at least three inches along the linear axis. The electrode array may further comprise a first dielectric material positioned between the first conductor and the at least one intermediate conductor and a second dielectric material positioned between the at least one intermediate conductor and the second conductor.

In various embodiments, and with reference to FIG. 1, an electrified weapon 100 is disclosed. Electrical weapon 100 may be similar to, or have similar aspects and/or components with, the electrical weapons previously discussed herein. It should be understood by one skilled in the art that FIG. 1 is an example illustration of electrical weapon 100, and one or more of the components of electrical weapon 100 may be located in any suitable position within, or external to, a housing of electrical weapon 100. In the example of FIG. 1, electrical weapon 100 is an electrified baton. Electrical weapon 100 may comprise a main body 110, an arm 120, and an electrode 130.

Main body 110 may be configured to house various components of electrical weapon 100 configured to generate a stimulus signal. Main body 110 may have an elongated shape as illustrated in FIG. 1. The elongated shape may extend from distal end 112 of the main body 110 to proximal end 114 of the main body 110 opposite distal end 112. A cross-section of main body 110 may be have around shape. The round shape may include a circular shape, though other shapes or combinations of shapes may be employed in various embodiments, including square, rectangular, and other polygonal shapes. A longest dimension of main body 110 may be a length between distal end 112 and proximal end 114 of main body 110. The length between distal end 112 and proximal end 114 may be at least eighteen inches, at least twenty-four inches, at least thirty inches, or at least thirty-six inches in embodiments according to various aspects of the present disclosure. In embodiments, a shaft of electrical weapon 100 comprises main body 110.

Main body 110 may include a handle 116 at or near proximal end 114. Handle 116 may include one or more surfaces configured to be held in one or more hands of a user. A texture or shape of the one or more surfaces may enable the user to firmly grip electrical weapon 100 in order to contact or place electrical weapon 100 proximate to a target. In embodiments, handle 116 may extend less than half a length of main body 110 or less than a quarter of a length of main body 110. In various embodiments, handle 116 may also comprise contours shaped to fit the hand of a user, for example, an ergonomic grip. Handle 116 may include a surface coating, such as, for example, a non-slip surface, a grip pad, a rubber texture, and/or the like. As a further example, handle 116 may be wrapped in leather, a colored print, and/or any other suitable material, as desired.

Main body 110 may further be coupled to arm 120. Arm 120 may be coupled to main body 110 at distal end 112 of main body 110. Arm 120 may be coupled to main body 110 between handle 116 and distal end 112 of main body. Arm 120 may be coupled along an elongated length of main body 110. An elongated length of arm 120 may be selectively disposed substantially parallel (e.g., parallel or +/−ten degrees from parallel) to an elongated length of main body 110. Arm 120 may be pivotably coupled to main body 110 via a moveable joint in embodiments according to various aspects of the present disclosure.

Arm 120 may include first end 122, second end 124, and electrode 130. First end 122 may comprise a pivot end of arm 120, wherein one or more portions of arm 120 at first end 122 pivotably couple arm 120 to main body 110. Second end 124 of arm 120 may comprise a contact end of arm 120, wherein one or more portions of arm 120 at second end 124 are configured to contact or be placed proximate a target. A housing of arm 120 comprising a plurality of surfaces may extend between first end 122 and second end 124. Electrode 130 may be disposed on a surface of arm 120 between first end 122 and second end 124.

In various embodiments, electrode 130 itself may extend along a length of arm 120. For example, electrode 130 may extend along at least half a length of arm 120 or at least a quarter of a length of arm 120. A length of electrode 130 may be substantially parallel (e.g., parallel or +/−ten degrees from parallel) to an elongated length of arm 120. In embodiments, the length of arm 120 may be a longest dimension of arm 120 and a length of electrode 130, substantially parallel to the length of arm 120, may also be longest dimension of electrode 130. Electrode 130 may be disposed closer to second end 124 of arm 120 than to first end 122 of arm 120. In embodiments, electrode 130 or another electrode may be disposed at second end 124. Electrode 130 may be integrated with arm 120 such that moving (e.g., pivoting, rotating, translating, etc.) arm 120 may cause electrode 130 to move as well. Electrode 130 may include an electrode array.

In various embodiments, main body 110 and arm 120 may each be formed of one or more rigid, durable materials able to withstand physical force(s) applied to the electrical weapon 100 by a user and/or target. For example, main body 110 and/or arm 120 may include one or more rigid, plastic materials. The one or more rigid materials may include non-conductive, dielectric materials configured to insulate handle 116 and other portions of electrical weapon 100 from a stimulus signal applied to electrode 130. One or more housings of each of main body 110 and arm 120 may comprise the one or more rigid, durable materials in embodiments according to various aspects of the present disclosure.

In various embodiments, a surface of arm 120 on which electrode 130 is disposed may include one or more non-planar surface features configured to protect electrode 130 and/or improve traction between the surface of arm 120 and a target in order to deliver a stimulus signal from electrode 130. The surface features may comprise one or more ridges and/or teeth, including one or more ridges of teeth that extend from the surface of arm 120. The surface features may comprise a regular pattern of repeating surfaces, including at least one raised surface or edge between surfaces of the surface features and a lower surface or edge between surfaces of the surface features. The surface features may comprise one or more surfaces that meet at an edge or point about the surface of arm 120. A surface or edge between surfaces of the surface features may be extended, parallel, or recessed with respect to the surface of arm 120 on which the surface features are disposed.

In various embodiments, surface features may be further disposed on a surface of arm 120 on each side of electrode 130. Electrode 130 may be disposed in a channel between two sets of the surface features. For example, a ridge of triangular surface features may extend from a surface of arm 120 on each side of an elongated length of electrode 130. Surfaces of electrode 130 may be disposed in a same plane along the surface of arm 120, while the surface features may extend from this plane. In other embodiments, surfaces of electrode 130 may follow (e.g., have same shape and/or orientation, be parallel, etc.) surfaces of the surface features, such that the surfaces of electrode 130 are also disposed non-planar with respect to a surface of arm 120 on which electrode 130 is disposed.

In various embodiments, arm 120 may be disposed in one or more positions relative to main body 110, including a first position as illustrated in FIG. 1. The first position may be a closed or compact position in which second end 124 of arm 120 contacts or is disposed proximate main body 110. One or more surfaces of arm 120, opposite a surface on which electrode 130 is provided on arm 120, may alternately or additionally be in contact or placed proximate main body 110 in the first position. In embodiments, second end 124 and/or one or more surfaces may be received by and/or have a shape complementary to a corresponding surface of main body 110. A complementary shaped surface may enable arm 120 to be received by or at least closely coupled with main body 110 to minimize an overall size of electrical weapon 100 in the first position. Such coupling may also improve rigidity of arm 120 upon contact with a target in the first position.

In various embodiments, an arm of an electrical weapon may be disposed in one or more second positions, different from a first position. A second position may include a different relative position between the arm and a main body of the electrical weapon. The different relative position may include one or more of a different orientation, different angular position, and different spacing between the arm and main body in comparison with an orientation, angular position, and spacing between the arm and main body in a first position of the arm.

Figure 2:
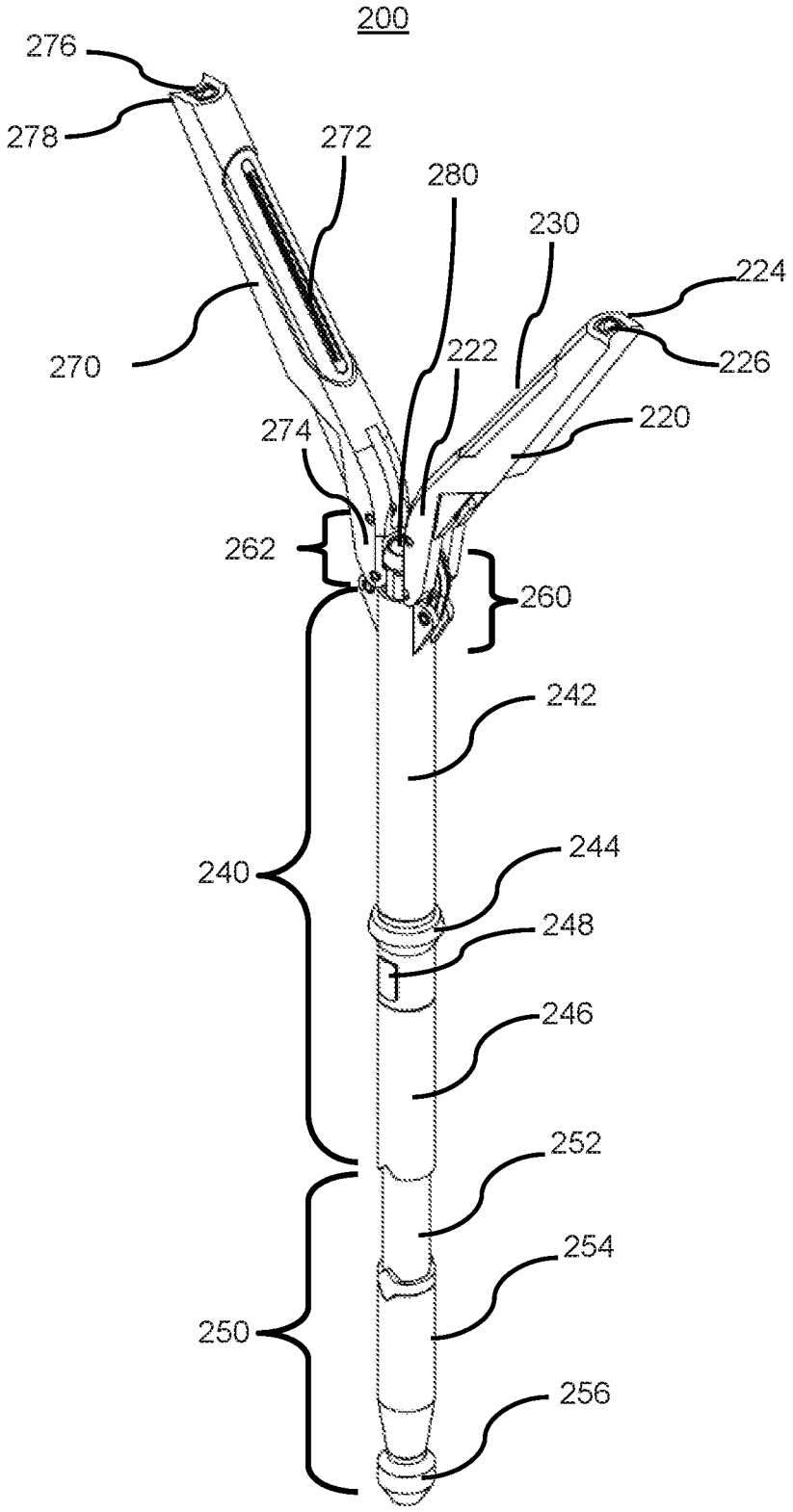
FIG. 2 illustrates a perspective view of an electrical weapon in accordance with various embodiments.

As illustrated in FIG. 2, electrical weapon 200 includes an arm 220 at a second position relative to a main body comprising first housing 240 and second housing 250. While a main body of electrical weapon 200 includes multiple housings 240,250, other embodiments of a main body according to various aspects of the present disclosure may include a single housing or three or more housings. The second position of arm 220 for electrical weapon 200 is different from a first position for such an arm, such as a position illustrated for arm 120 of electrical weapon 100 (with brief reference to FIG. 1). The second position may be an open or expanded position, while a first position may be a closed or compact position in embodiments according to various aspects of the present disclosure. In embodiments, electrical weapon 200 may be an electrified baton. In embodiments, electrical weapon 200 may correspond to electrical weapon 100 of FIG. 1, wherein arm 220 corresponds to arm 120 moved to a different, second position relative to main body 110 of electrical weapon 100.

First housing 240 may couple to second housing 250. Each of first housing 240 and second housing 250 may have an elongated shape extending from a first end to a second end opposite the first end. The coupling may be adjustable, such that a position of the first housing 240 may be altered relative to a position of second housing 250 while remaining coupled to the second housing 250. First housing 240 may include an outer housing comprising a bore configured to receive second housing 250. Second housing 250 may include an inner housing configured to be at least partially received in first housing 240.

First housing 240 may include various elements, including one or more of a distal portion 242, a guard portion 244, a first handle portion 246, and a user interface 248. In embodiments, each of these elements may be integrally coupled with one or more other elements of first housing 240.

Distal portion 242 may include one or more surfaces to which an arm (e.g., arm 220 or arm 120 with brief reference to FIG. 1) may be coupled or placed in contact. Distal portion 242 may be disposed between a first end at which an arm (e.g., arm 220) is coupled and a second end at which guard 244 is coupled. Exterior surfaces of distal portion 242 may be complementary in shape to one or more inner surfaces of an arm (e.g., arm 220), wherein the one or more inner surfaces include one or more surfaces of the arm closest to distal portion 242 in one or more positions of the arm.

Guard portion 244 may be disposed between a distal portion 242 of first housing 240 and a first handle portion 246 of first housing 240. Guard portion 244 may include one or more surfaces that extend a greater distance from a central axis of first housing 240 than a distance to which first handle portion 246 extends from the axis, such that a hand of a user sliding along the first handle portion 246 may contact guard 244 instead of continuing to slide toward distal portion 242 and arm 220. Guard 244 may be shaped to increase a surface area and a range of directions in which a hand of a user may contact first housing 240, thereby improving a grip of the user on electrical weapon 200.

First handle portion 246 may include one or more surfaces along a main body of electrical weapon 200 by which a user may grip electrical weapon 200. The one or more surfaces may be textured and/or non-slip in order to improve contact between portion 246 and a hand of a user. User interface 248 may be disposed on first handle portion 246 and the one or more surfaces may be disposed around user interface 248. First handle portion 246 may be separate and separately moveable from another portion of a handle of electrical weapon 200, such as second handle portion 254.

In embodiments, user interface 248 may be configured to control selection of operating modes of electrical weapon 200. Controlling operating modes may include enabling or disabling provision of a stimulus signal to one or more electrodes of electrical weapon, such as electrode 230. Controlling operating modes may include altering a position of an arm (e.g., arm 220) of electrical weapon 200.

User interface 248 may be located at any suitable location on or in a housing. For example, user interface 248 may be disposed on an outer surface of a first handle portion 246 of electrical weapon 200 to permit manual actuation of user interface 248 by a hand of a user. User interface 248 may be coupled to an outer surface of housing 240 proximate guard 244. In other embodiments, user interface 248 may be disposed on second handle portion 254 of second housing 250 and/or a plurality of user interfaces 248 may be disposed on housing 240 and/or 250 to configure one or more modes of electrical weapon 200 to be controlled from one or more locations on electrical weapon 200. In embodiments, user interface 248 may be further disposed on guard 244.

User interface 248 may comprise one or more suitable electronic or mechanical components capable of enabling selection of operating modes of electrical weapon 200. For example, user interface 248 may comprise one or more of a switch, button, a safety switch, a rotating switch, a selection switch, a selective activation mechanism, and/or any other suitable mechanical control switch. As a further example, user interface 248 may comprise a touch screen or similar electronic control device. In embodiments, user interface 248 may include at least a trigger and a control interface.

In embodiments, second housing 250 may include an inner portion 252, a second handle portion 254, and a pommel portion 256. Inner portion 252, second handle portion 254, and pommel portion 256 may be integrally coupled. Inner portion 252 may be coupled to second handle portion 254 and second handle portion may be coupled to pommel portion 256. Inner portion 252, second handle portion 254, and pommel portion 256 may be disposed along a length of second housing 250. Inner portion 252, second handle portion 254, and pommel portion 256 may be disposed along a longest dimension of second housing 250.

Inner portion 252 may include one or more surfaces along a central axis of a main body of electrical weapon 200 that are configured to engage first housing 240. The one or more surfaces may be complementary in shape to one or more inner surfaces of a bore of first housing 240, enabling inner portion 252 to fit within first housing 240. Inner portion 252 may be sized to be received inside a bore of first housing 240. A length of the one or more surfaces may be greater than a corresponding length of first housing 240, such that first housing 240 may travel to different positions along inner housing 252 while continuing to enclose a part of inner portion 252, but less than an entire length of inner portion 252. A difference in lengths between inner portion 252 and first housing 240 may enable part of inner portion 252 to not be enclosed by first housing 240, independent of a position of travel of first housing 240 along inner portion 252 and along the central axis. In embodiments, a first end of inner portion 252, corresponding to a distal end of main body of electrical weapon 200 may be configured to prevent the first housing 240 from traveling beyond and/or enclosing the first end of inner portion 252, thereby securing moveable first housing 240 to electrical weapon 200. A diameter of inner portion 252 along the central axis may be less than a diameter of first housing 240 along a corresponding length of first housing 240, such that inner portion 252 may be adjustably received within first housing 240, thereby enabling travel of inner portion 252 within first housing 240. In embodiments, inner portion 252 may extend from second handle portion 254, through first housing 240, and to a distal end of a main body of electrical weapon 200. Inner portion 252 may couple to second handle portion 254 and, in embodiments, first housing 240 may selectively engage second handle portion 254 in accordance with a position of travel of first housing 240 along inner portion 252.

Second handle portion 254 may include one or more surfaces along a central axis of a main body of electrical weapon 200 that are configured to permit a hand of a user to hold electrical weapon 200. The one or more surfaces may extend a radial distance from the central axis an amount greater than a radial distance to which inner portion 252 extends from the central axis, such that travel of first housing 240 along inner portion 252 is prevented beyond a boundary of second handle portion 254 between inner portion 252 and second handle portion 254. In embodiments, second handle portion 256 may have a same diameter as first handle portion 248. An end of second handle portion 254 opposite an end coupled to inner portion 252 may be coupled to a pommel portion.

In use, a first hand of a user may hold first handle portion 242 and a second hand of a user may hold a second handle portion 254, enabling the user to manually move first housing 240 relative to second housing 250. The movement may include sliding first housing 240 along second housing 250. In embodiments, the movement may provide a source of motion useable to move an arm of electrical weapon 200 (e.g., arm 220) between different positions of the arm.

In embodiments, pommel portion 256 is configured to improve contact between electrical weapon 200 and a hand of a user. Pommel portion 256 may include one or more surfaces at orientations and/or distances from a central axis of a main body of electrical weapon 200 that are different from orientations and/or distances of one or more surfaces of coupled second handle portion 254. The difference in adjacent surfaces may provide additional surface features by which a hand of a user may grip second housing 250. Pommel portion 256 may prevent a hand of a user from sliding off an end of second housing 250 at which pommel portion 256 is disposed. Pommel portion 256 may have a diameter greater than second handle portion 254 and a circular shape, rather than a cylindrical or other shape of second handle portion 254. An end of pommel portion 256 may correspond to a proximal end of a main body of electrical weapon 200.

At a distal end of a main body of electrical weapon 200, first housing 240 may be configured to enable arm 220 to move between a first position and one or more second positions. The first position may be a closed position and each second position may be one or more open positions. Movement of arm 220 may include pivoting of arm 220 relative to first housing 240 and second housing 250. Pivoting of arm 220 may include rotation of arm within a plane. Rotation within the plane may be enabled about one or more axes perpendicular to the plane. In embodiments, movement between the positions may be enabled via an actuator 260.

In embodiments, actuator 260 may be configured to pivotably couple arm 220 to first housing 240 in order to enable arm 220 and electrode 230 to be disposed at different positions. The different positions may include different angular positions relative a reference position and/or orientation of first housing 240. In embodiments, actuator 260 may include a joint and a source of motion.

In embodiments, a joint between an arm and a main body of an electrical weapon may include a hinge. The hinge may include a complex hinge comprising two or more axes about which parts of the hinge rotate. In other embodiments, a hinge may include a simple hinge comprising a single axis. The one or more axes of a hinge may be defined by one or more manners in which portions of the hinge interconnect.

As illustrated in FIG. 2, a joint of actuator 260 may include a complex hinge. The complex hinge may include a support rod rotatably coupled at a first end to arm 220. The support rod may be rotated relative to arm 220 about a first axis at the first end. A second end of the support rod, opposite the first end, may be rotatably coupled to a portion of first housing 240. The support rod may be rotated relative to the portion of the first housing 240 about a second axis at the second end. The complex hinge may further include a portion of second housing 250 rotatably coupled about a third axis to arm 220. Particularly, a portion of inner portion 252 of second housing 250 may be coupled to arm 220. A distal end of inner portion 252 may be coupled to arm 220 about the third axis. The distal end may be coupled via another hinge, separate from another hinge formed by a support rod between arm 220 and first housing 240. The third axis may have a stationary position relative to electrical weapon 200, while the first and second axes may each have an adjustable position relative to electrical weapon 200. The third axis may not move when arm 220 changes positions, though the first and second axes may move with arm 220 and first housing 240 when the arm 220 is adjusted to different positions. In embodiments, each coupling of the complex hinge may include an individual, simple hinge, wherein a pin of the hinge enables rotation about the respective axis. In other embodiments, the joint may comprise a single hinge and/or a single axis, rather than a plurality of hinges or axes. In other embodiments, a joint of actuator 260 may include different types of couplings, including one or more of a ball joint, prismatic joint, screw joint, revolute joint, and a universal joint.

For actuator 260, a source of motion may include manual actuation of first housing 240 along second housing 250. Manual actuation may include linear motion of first housing 240 along second housing 250. The linear motion may be translated into rotational motion by the joint of actuator 260 in accordance with one or more axes and couplings of portions of the joint. Movement of first housing 240 toward a distal end of electrical weapon 200 may cause arm 220 to move away from first housing 240 and second housing 250. Movement of first housing 240 toward a proximal end of electrical weapon 200 may cause arm 220 to move toward first housing 240 and second housing 250. The source of motion may provide a bidirectional force, wherein a direction of the force enables an arm (e.g., arm 220) of electrical weapon 200 to move toward a first position or, in an opposite direction, toward one or more second positions. In embodiments, the source of motion of actuator 260 may include one or more springs to apply a sustained force to slide first housing 240 toward a proximal end of electrical weapon 200, such that arm 220 may be retained (e.g., biased, resist movement away from, etc.) in a second or open position. A latch or other mechanical catch may prevent the force from the one or more springs from being applied to the first housing 240 until a selection of an operating mode is received via a user interface 248 of electrical weapon 200. In embodiments, a source of motion of actuator 260 may further alternately or additionally include one or more pins, teeth, gears, or other mechanical structures to retain an arm (e.g., arm 220) in one or more of a second position and a first position.

In other embodiments, an actuator for an arm of an electrical weapon may include one or more motors, gears, or other electromechanical elements configured to move the arm between a first position and one or more second positions. These other elements may be selectively controlled by a user interface of the electrical weapon. For example, an actuator may include a motor, such as a servomotor, directly coupled to a joint between the arm and a main body of the electrical weapon. The motor may be directly controlled by one or more control signals received from an associated user interface. In embodiments, a physical force from a user may not be required beyond manual activation of a user interface in order to cause a change in position of an arm of an electrical weapon. An arm of an electrical weapon may be actuated via an actuator to different positions independent of a manual force applied to the electrical weapon, aside from an actuation of a user interface.

In embodiments, arm 220 may be coupled to actuator 260 at a first end 222. First end 222 may be a pivot end of arm 220. First end 222 may maintain physical connection with second housing 250 via actuator 260, including during movement of arm 220 from a first position to one or more second positions.

In embodiments, arm 220 may include a second end 224 configured to contact or be placed proximate a target. Second end 224 may be a contact end of arm 220. Second end 224 may travel a highest distance among all parts of arm 220 when upon arm 220 is moved from a first position to a second position. Electrode 226 may be disposed on second end 228. Electrode 226 may comprise a contact electrode. When a stimulus signal is provided by electrical weapon 200, the stimulus signal may be provided to a target via electrode 226 in combination with another electrode of electrical weapon 200. Electrode 226 may be placed electrically connected in series with the target and another electrode to provide the stimulus signal in a signal path through the electrode, target tissue, and the other electrode. Electrode 226 may provide the stimulus signal to a target at a maximum distance between the target and a proximal end of the electrical weapon 200 at which a user of electrical weapon 200 may be positioned during use of electrical weapon 200.

In embodiments, arm 200 may include an electrode 230 between first end 222 and second end 224 that is configured to contact or be placed proximate a target independent of a position of arm 220. Electrode 230 may correspond to electrode 130 of FIG. 1. Electrode 230 may be a capacitive electrode. Electrode 230 may comprise a series of conductors. Electrode 230 may be configured to transfer a stimulus signal from a first end of the electrode 230 to a second end of the electrode 230 via ionization of air, resulting in a visible arc along electrode 230. In embodiments, electrode 230 may be positioned on a surface of arm 220 such that electrode 230 may contact or be placed proximate a target when arm 220 is in an open position. An electrode such as electrode 230 may also be positioned on the same surface such that the electrode may contact or be placed proximate a target when an arm is in a closed position, such as illustrated by electrode 130 with brief reference to FIG. 1. In embodiments, an electrode configured to provide the stimulus signal in the open position and the closed position may be a same electrode. Electrode 230 may transfer a stimulus signal across its surface, corresponding to a visible, electrical arc, when arm 220 is disposed in each of a first position and one or more second positions.

In embodiments, electrode 230 may be disposed along a length of arm 220 in order to provide multiple locations at which electrode 230 may provide a stimulus signal to a target, as well as increase a distance between two portions of same electrode 230 via which the stimulus signal may be provided through a target. In embodiments, the length may be at least 6 inches in order to increase a likelihood that a provided stimulus signal will cause NMI.

In embodiments, one or more of a size, surface area, or length of electrode 230 may be greater than a corresponding size, surface area, or length of electrode 226. Such an arrangement may increase a range of positions between electrical weapon 200 and a target by which electrode 230 may transfer a stimulus signal to the target. In contrast, electrode 226 may provide the stimulus signal from a lesser degree or range of positions relative to a target. Electrode 226 may enable a stimulus signal to be applied at a maximum distance between a pommel portion 256 and a target, but fewer relative positions between weapon 200 and the target, while electrode 230 may enable the stimulus signal to be applied at less than the maximum distance between pommel portion 256 and the target, but a more relative positions between weapon 200 and the target.

In embodiments, one or more additional electrodes may be placed in other locations on electrical weapon 200. For example, another capacitive electrode may be disposed along an inner surface of arm 220 proximate toward first housing 240. The other electrode may provide an additional location at which a stimulus signal may be provided. The other electrode may also provide an additional visible arc upon activation of user interface 248 of electrical weapon 200. The inner surface may be opposite a surface of arm 220 on which electrode 230 is disposed. The other electrode may be a second electrode, configured to provide a stimulus signal when electrical weapon 200 is disposed in an open position and/or configured to be enclosed, blocked, or otherwise protected by a housing of electrical weapon 200 when arm 220 is disposed in a first position. A surface of the other electrode may be disposed in an orientation opposite an orientation of electrode 230. In embodiments, other combinations of electrodes may be disposed on arm 220, including three or more electrodes on three or more different surfaces and/or different orientations. In embodiments, another electrode may be positioned at other locations on electrical weapon 200, including along a main body of electrical weapon or at a distal end of the main body of electrical weapon 200.

In embodiments, electrical weapon 200 may include another arm 270 on which one or more additional electrodes are disposed. Arm 270 may include a first end 274, a second end 278, electrode 272 and electrode 276. Each element of arm 270 may correspond to an element of arm 220, though arm 270 is oriented and positioned on an opposite side of electrical weapon relative to arm 220. Elements of arm 270 may duplicate elements or features of arm 220. Arm 270 may be a second arm, relative to first arm 220. Arm 270 and arm 220 may be symmetrically positioned on electrical weapon 200. Arm 270 may be coupled to move symmetrically to arm 220 about a central axis of a main body of electrical weapon 200.

Electrode 272 may comprise a second electrode of electrical weapon 200. Electrode 272 may mirror electrode 230 of arm 220 in terms of orientation, position, and other features of arm 270 relative to an orientation, position, and other features of electrode 230 on arm 220. Electrode 272 and electrode 230 may each include a capacitive electrode. Electrode 272 may be positioned between a first end 274 and second end 278 of arm 270. First end 274 may comprise a pivot end of arm 270 and second end may comprise a contact end of arm 270.

Arm 270 may include another electrode 276. Electrode 276 may be positioned at a second end 278 of arm 270. A position of electrode 276 at second end 278 may be similar (e.g., symmetrical) to a position of electrode 226 at second end 224 of arm 220. Electrode 276 may include a contact electrode. Electrode 276 may be electrically coupled in series with electrode 272 to receive a same stimulus signal as electrode 272.

Actuator 262 may pivotably couple arm 270 to first housing 240. Actuator 262 may correspond to actuator 260, though coupled to arm 270 to move arm 270 in a different direction than a direction by which arm 220 moves via actuator 260. A joint of each actuator 260,262 may be a same type of joint comprising matching portions between each joint. For example, actuator 262 may comprise a second support rod interconnecting first housing 240 and second arm 270. Actuator 262 may also comprise a hinge by which second arm 270 is coupled to inner portion 252 of second housing 250. Each actuator 260, 262 may include a separate joint, though a same source of motion. A source of motion for each actuator 260,262 may be a same source, such that a force from the source of motion may cause movement of both arms 220 and 270 in parallel. For example, both arms 220,270 may move from a respective first position to a respective second position upon application of force from the source of motion for both actuators 260,262. In example embodiment according to FIG. 2, movement of first housing 240 relative to second housing 250 may cause both arms 220,270 to pivot symmetrically about respective axes of motion established by hinges in each of actuators 260,262.

In embodiments, electrical weapon 200 may further include a transducer 280 configured to transmit or receive an additional signal during use of the electrical weapon 200. Transducer 280 may be coupled to a distal end of electrical weapon 200. A signal transmitted by transducer 280 may include an audio signal configured to one or more of alert a target to a presence of electrical weapon 200 and deter an action by a target. A signal received by transducer 280 may include an audio signal configured to capture words, sounds, noises, and other acoustic events in an environment in which electrical weapon 200 is employed. A signal received by transducer 280 may include an audio signal configured to capture words, sounds, noises, and other acoustic events in an environment in which electrical weapon 200 is employed. A signal received by transducer 280 may include a video signal configured to capture visible information in an environment in which electrical weapon 200 is employed. The transducer 280 may selectively receive or transmit one or more signals in accordance with actuation of user interface 248. In other embodiments, transducer 280 may include an electrode by which a stimulus signal may be provided in addition to and/or in place of a signal otherwise received or transmitted from electrical weapon 200.

Figure 3:
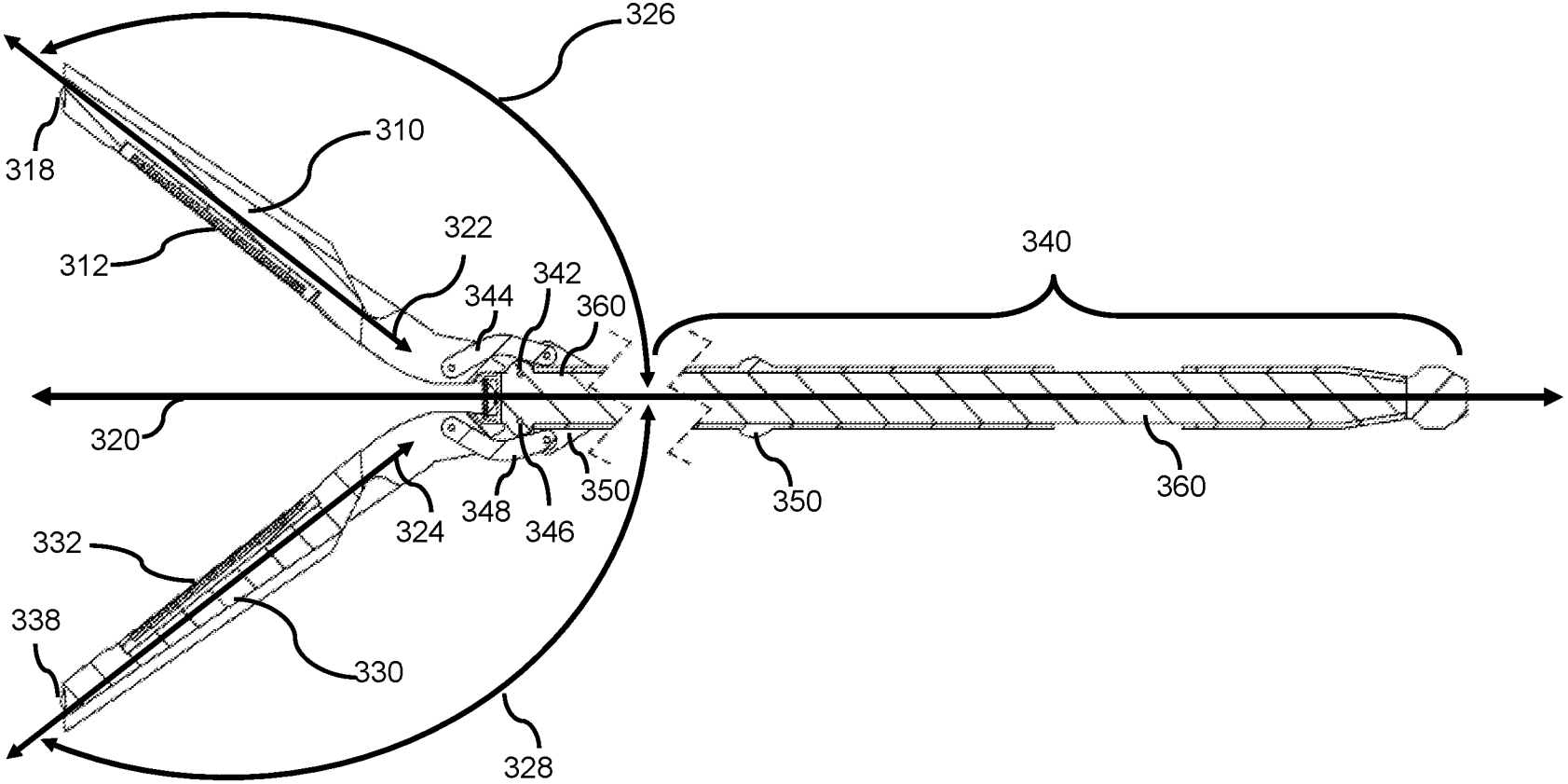
FIG. 3 illustrates a cross section of an electrical weapon, in accordance with various embodiments.

In the embodiment of FIG. 3, electrical weapon 300 may be configured to be adjusted to different configurations for use, wherein electrodes are configured to provide a stimulus signal in each of the different configurations. A position of at least one arm of electrical weapon 300 may be different in each configuration. In embodiments, electrical weapon 300 may correspond to electrical weapon 100 and electrical weapon 200 (with brief reference to FIGS. 1-2). In each configuration, a stimulus signal may be applied via one or more electrodes of electrical weapon 300, thereby enabling the stimulus signal to be provided in different configurations of the electrical weapon, as well as different orientations between a user of the weapon and a target. The different configurations may also increase (e.g., distribute) an area over which contact or proximate placement of the electrical weapon may deliver a stimulus signal causing NMI.

Electrical weapon 300 may have a first arm 310, a second arm 330, and a main body 340 comprising an outer housing 350 and an inner housing 360. First arm 310 may correspond to one or more of first arm 110 or first arm 220, second arm 330 may correspond to second arm 270, main body 340 may correspond to main body 110, outer housing 350 may correspond to first housing 240, and/or inner housing 360 may correspond to second housing 250 according to various aspects of the present disclosure, with brief reference to FIGS. 1 and 2.

Main body 340 of electrical weapon 300 may have a central axis 320. Axis 320 may bisect main body 340 along a length of the main body 340. As illustrated in FIG. 3, the length may correspond to a longest dimension of the main body 340. Axis 320 may further bisect and/or extend along a longest dimension of one or more of first or outer housing 350 and second or inner housing 360. Main body 340 may be symmetrical about axis 320, including in one or more planes in which axis 320 is disposed.

First arm 310 may include an extension axis 322. Extension axis 322 may be a central axis of arm 310. Extension axis 322 may be parallel to a direction along which electrode 312 is disposed. A longest dimension of electrode 312 may be parallel to extension axis 322. Extension axis 322 may be located along a longest dimension of first arm 310. Extension axis 322 may bisect a housing of first arm 310 in one or more dimensions of first arm 310 perpendicular to extension axis 322. Extension axis 322 may be co-planar with central axis 320.

Second arm 330 may include a second extension axis 324. Extension axis 324 may be a central axis of arm 330. Extension axis 324 may be parallel to a direction along which electrode 332 is disposed. A longest dimension of electrode 332 may be parallel to extension axis 324. Extension axis 324 may be located along a longest dimension of second arm 330. Extension axis 324 may bisect a housing of second arm 330 in one or more dimensions of second arm 330 perpendicular to extension axis 324. Extension axis 324 may be co-planar with central axis 320. In embodiment, each of first extension axis 322, second extension axis 324, and central axis 320 may be separate axes. Each of first extension axis 322, second extension axis 324, and central axis 320 may also be coplanar in embodiments according to various aspects of the present disclosure.

First arm 310 may move relative to main body 340. The movement may include movement of arm 310 from a position to another to a position. Moving arm 310 may include rotating arm 310. The movement may be defined by or at least correspond to movement of axis 322 relative to axis 320 of main body 340. Arm 310 may move to or from a first position in which axis 322 is substantially parallel to axis 320. Arm 310 may move from or to one or more second positions in which axis 322 is not substantially parallel to axis 320.

Rotation of arm 310 may be enabled by a joint configured to move the arm 310 between a first position and one or more second positions. The joint may define an axis of rotation of arm 310 relative to main body 340. The joint may pivotably couple arm 310 to main body 340. The joint may enable a position of arm 310 to change upon actuation, activation, or other application of a source of motion.

A joint may include a first hinge 342. First hinge 342 may provide an axis of rotation by which arm 310 rotates relative to main body 340. First hinge 342 may include a part of main body 340 at a distal end of main body 340. The part of the main body 340 at the distal end of main body 340 may include a part of an inner housing 360 of main body 340. The part of inner housing 360 may include a distal end of inner housing 360. The part of inner housing 360 included in hinge 342 may have a radius from axis 320 that is greater than a radius of outer housing 350, such that the part of inner housing 360 may not be received inside outer housing at the distal end of main body 340. The part of inner housing 360 included in hinge 342 may have a bore disposed therethrough. A pin through the bore may pivotably couple inner housing 360 to arm 310 via hinge 342.

First hinge 342 may also include apart of arm 310. The part of arm 310 included in hinge 342 may be located at a pivot end of arm 310. The part of arm 310 included as part of hinge 342 may have a bore disposed therethrough. A pin through the bore may pivotably couple inner housing 360 to arm 310 via hinge 342. A same pin through bores in each of arm 310 and main body 340 may rotatable couple arm 310 to main body 340. Hinge 342 may define a plane in which arm 310 rotates relative to main body 340. In other embodiments, hinge 342 may include one or more additional mechanical elements (e.g., sockets, catches, gears, etc.) configured to provide an axis of rotation about which arm 310 may pivot relative to main body 340 of electrical weapon 300.

A joint for arm 310 may further include a second hinge 344 configured to couple arm 310 to another part of main body 340. Second hinge 344 may couple arm 310 to an outer housing 350 of main body, such that arm 310 is coupled to different parts of main body 340. Hinge 344 may include a support arm and apart of arm 310. The part of arm 310 may be located at a pivot end of arm 310. The part of arm 310 may also further beat a different location from hinge 342 and/or closer to a contact end of arm 310 than apart of arm 310 included with hinge 342. A first pin may be disposed through a bore in the support arm and a bore in the part of arm 310 included in hinge 344. A second pin may be disposed through a bore in the support arm and a bore in part of housing 350 included in hinge 344. The first pin and second pin and their associated bores may be disposed at opposite ends of the support arm included in second hinge 344. The second hinge 344 may transfer motion of inner housing 360 relative to outer housing 350 into motion of arm 310 relative to main body 340. Particularly, hinge 344 may translate linear motion of outer housing 350 into rotational motion of arm 310 relative to main body 340. Hinge 344 may move upon actuation of the joint, while hinge 342 may remain stationary relative to a distal end of main body 340. In embodiments, moving arm 310 from a first position to a second position may include moving second hinge 344 along axis 320 beyond first hinge 342. In the first position, second hinge 344 may be closer to a proximal end of main body 340 than first hinge 342, while in the second position, a support arm of second hinge 344 may be positioned across first hinge 342 along axis 320. A pin and/or or axis of rotation of second hinge 344 may move past a pin and/or axis of rotation defined by first hinge 342 along axis 320 upon movement of arm 310 between the first position and the second position. In embodiments, a complex hinge may include hinge 342 and hinge 344. In embodiments, the joint may include other types of hinges for translating linear motion into rotational motion, including those with additional or alternate elements for a support rod as disclosed herein. In embodiments, a joint may not include a second hinge, relying on a first hinge to enable rotational movement of an arm in response to an applied source of motion.

In embodiments, a joint between arm 310 and main body 340 may include a high voltage rotating joint configured to conduct a stimulus signal through the joint. The high voltage rotating joint may include one or more of first hinge 342 and second hinge 344. The high voltage rotating joint may include a conductor on each part of arm 310 and main body 340 in the hinge 342 and/or hinge 344. A pin of each of the one or more hinges 342,344 may cause the conductors to be placed in physical contact and remain in physical contact during use of electrical weapon 300. The conductors on respective parts of arm 310 and main body 340 may remain in electrical contact throughout a range of motion 326 of a high voltage rotating joint comprising hinge 342 and/or hinge 344, such that a stimulus signal may be conducted through the joint indifferent positions of arm 310 relative to main body 340. At least one of the conductors may include a circular surface area configured to contact and/or be placed proximate the other conductor during rotation of the arm 310. At least one of the conductors of the high voltage rotating joint may encircle or at least partially encircle an axis of rotation of each of one or more hinges 342,344 included in the high voltage rotating joint. One or more of the conductors may be protected by the part of arm 310 or main body 340 of which the one or more hinges 342,344 may be formed, thereby preventing external contact with the conductors. By conducting a stimulus signal through a high voltage rotating joint, compactness of the joint may be improved while also ensuring the safety and integrity of providing a stimulus signal from a signal generator in main body 340 to an electrode on arm 310, such as electrode 312. In embodiments, a joint between arm 330 and main body 340 may include a second high voltage rotating joint comprising one or more same features, elements, or properties as discussed above with respect to a high voltage rotating joint between arm 310 and main body 340.

In embodiments, a high voltage rotating joint for arm 310 may include at least two pairs of conductors, wherein one conductor of each pair is coupled to main body 340 and the other conductor of the pair is coupled to arm 310. In combination, the at least two pairs of conductors may provide a complete electrical circuit to and from arm 310, wherein each pair of conductors is part of a common channel.

In embodiments, each pair of conductors of a high voltage rotating joint may conduct a different portion of a stimulus signal to one or more electrodes or other elements on arm 310. For example, a first pair of conductors may provide a positive voltage portion of the stimulus signal to arm 310, while a second pair of conductors may provide a negative voltage portion of the stimulus signal to arm 310.

In other embodiments, a joint may not be conductive. In an example of such other embodiments, one or more conductive wires may provide a stimulus signal to an arm from a main body of the electrical weapon, rather than a high voltage rotating joint. The one or more conductive wires may provide the stimulus signal around a joint between the arm and main body, rather than through the joint.

Arm 310 may have a range of motion 326 relative to main body 340. Range of motion 326 may include a range of rotation enabled by one or more of hinge 342,344 of a joint. Range of motion 326 may have a first end at or proximate main body 340 and axis 320. Range of motion 326 may have a second end, opposite the first end, away from main body 340 and axis 320. The second end of range of motion 326 may not cross axis 320 of main body 340. A source of motion, when applied to a joint between arm 310 and main body 340, may cause arm 310 to move through range of motion 326. Linear motion of outer housing 350 toward a distal end of main body 340 may cause arm 310 to rotate away from main body 340 within range of motion 326. Linear motion of outer housing 350 toward a proximal end of main body 340 may cause arm 310 to rotate toward main body 340 through range of motion 326. In embodiments, range of motion 326 may be greater than ninety degrees. For example, range of motion 326 may be at least one hundred-twenty degrees, at least one-hundred thirty-five degrees, or at least one-hundred fifty degrees. A first position of arm 310 may correspond to a first end of range of motion 326 in which arm 310 is proximate or against main body 340. One or more second positions may include other angular positions within range of motion 326 to which arm 310 may be rotated, including a position at an opposite end of range of motion 326 from a first end that corresponds to a first position of arm 310. A position of arm 310 within the range of motion 326 may define an angle between axis 322 and axis 320 according to various aspects of the present disclosure.

Arm 310 may be limited from rotating beyond range of motion 326. At a first end of range of motion 326, arm 310 may physically contact main body 340. At an opposite end, one or more of hinge 342, hinge 344, or a physical size or shape of arm 310 relative to other components of electrical weapon 300 may prevent further rotation of arm 310. In embodiments, a limit of a range of motion 326 may also correspond to an operational limit (e.g., maximum travel, maximum force, etc.) of a source of motion coupled to a joint between arm 310 and main body 340.

In embodiments, elements of arm 310 may rotate with arm 310 through range of motion 326. A contact end may pivot through range of motion 326, as may electrode 312. An orientation of electrode 312, which may be perpendicular to extension axis 322 may also change throughout range of motion 326. For example, in a first position, electrode 312 and a surface of arm 310 on which electrode 312 is disposed may be perpendicular to axis 320. In a second position between ends of range of motion 326, an orientation of electrode 312 and a surface on which electrode 312 is disposed may be parallel to axis 320. In another second position at or proximate an end of range of motion 326, an orientation of electrode 312 and a surface on which electrode 312 is disposed may be oriented to intersect with axis 320. In this example, an orientation of one or more of electrode 312 and a surface on which electrode 312 is disposed may be perpendicular to extension axis 322 of arm 310.

Second arm 330 may also move relative to main body 340. The movement may include movement of arm 320 from a position to another to a position. Moving arm 330 may include rotating arm 330. The movement may be defined by or at least correspond to movement of axis 324 relative to axis 320 of main body 340. Arm 330 may move to or from a first position in which axis 324 is substantially parallel to axis 320. Arm 330 may move from or to one or more second positions in which axis 324 is not substantially parallel to axis 320. In the one or more second positions, extension axis 324 may be configured to intersect with axis 320.

Rotation of arm 330 may be enabled by a joint configured to move the arm 330 between a first position and one or more second positions. The joint may define an axis of rotation of arm 330 relative to main body 340. The joint may pivotably couple arm 330 to main body 340. The joint may enable a position of arm 330 to change upon actuation, activation, or other application of a source of motion. In embodiments, arm 330 and arm 310 may change position simultaneously as enabled by respective joints of arms 310, 330. A position of each arm 310 and 330 may change concurrently in accordance with an applied, common source of motion. The position of each arm may change concurrently in accordance with a first joint of arm 310 and a second joint of arm 330 being respectively coupled to one or more same portion of main body 340 (e.g., one or more of outer housing 350 and inner housing 360).

A joint between arm 330 and main body 340 may include another first hinge 346. First hinge 346 may provide an axis of rotation by which arm 330 rotates relative to main body 340. First hinge 346 may include a part of main body 340 at a distal end of main body 340. The part of the main body 340 at the distal end of main body 340 may include a part of an inner housing 360 of main body 340. The part of inner housing 360 may include a distal end of inner housing 360. The part of inner housing 360 included in hinge 346 may have a radius from axis 320 that is greater than a radius of outer housing 350, such that the part of inner housing 360 may not be received inside outer housing at the distal end of main body 340. The part of inner housing 360 included as part of hinge 346 may have a bore disposed therethrough. A pin through the bore may pivotably couple inner housing 340 to arm 330 via hinge 346. In embodiments, hinge 346 may be symmetrically positioned on electrical weapon relative to hinge 342. Hinge 346 may be configured to mirror operations of hinge 342 on an opposite side of axis 320 and in opposite directions from axis 320 relative to hinge 342.

First hinge 346 may also include a part of arm 330. The part of arm 330 included in hinge 346 may be located at a pivot end of arm 330. The part of arm 330 included as part of hinge 346 may have a bore disposed therethrough. A pin through the bore may pivotably couple inner housing 360 to arm 330 via hinge 346. A same pin through bores in each of arm 330 and main body 340 may rotatable couple arm 330 to main body 340. Hinge 346 may define a plane in which arm 330 rotates relative to main body 340. The plane may be a same plane in which hinge 342 is configured to enable rotation of arm 310. In other embodiments, hinge 346 may include one or more additional mechanical elements (e.g., sockets, catches, gears, etc.) configured to provide an axis of rotation about which an arm may pivot relative to a main body of an electrical weapon.

A joint for arm 330 may further include another second hinge 348 configured to couple arm 330 to another part of main body 340. Second hinge 348 may couple arm 330 to an outer housing 350 of main body, such that arm 330 is coupled to different parts of main body 340. Hinge 348 may include a support arm and a part of arm 330. The part of arm 330 may be located at a pivot end of arm 330. The part of arm 330 may further be at a different location from hinge 346 and/or closer to a contact end of arm 330 than a part of arm 330 included with hinge 346. A first pin may be disposed through a bore in the support arm and a bore in the part of arm 330 included in hinge 348. A second pin may be disposed through a bore in the support arm and a bore in part of housing 350 included in hinge 348. The first pin and second pin may be disposed at opposite ends of the support arm included in second hinge 348. The second hinge 348 may transfer motion of inner housing 360 relative to outer housing 350 into motion of arm 330 relative to main body 340. Particularly, hinge 348 may translate linear motion of outer housing 350 into rotational motion of arm 330 relative to main body 340. Hinge 348 may move upon actuation of the joint, while hinge 346 may remain stationary relative to a distal end of main body 340. In embodiments, a same linear motion of outer housing 350 may be concurrently translated into rotational motion by each joint of the arms 310,330, including as enabled by second hinges 344,348 of each arm 310,330. In embodiments, the joint of arm 330 may include other types of hinges for translating linear motion into rotational motion, including those with additional or alternate elements for a support rod as disclosed herein. In embodiments, a joint may not include a second hinge, relying on a first hinge to permit rotational movement of an arm.

In embodiments, a joint between arm 330 and main body 340 may include a second high voltage rotating joint. The second high voltage rotating joint may comprise one or more same features, elements, or properties as discussed above with respect to a first high voltage rotating joint between arm 310 and main body 340. The second high voltage rotating joint may be disposed and configured to move symmetrically with respect to the first high voltage rotating joint. The second high voltage rotating joint may enable a second stimulus signal to be conducted through the joint, rather than around the joint, to one or more electrodes (e.g., 332,338) of arm 330.

Arm 330 may have a range of motion 328 relative to main body 340. Range of motion 328 may be a second range of motion, different from first range of motion 326. Range of motion 328 may include a range of rotation enabled by one or more of hinge 346,348 of a joint. A source of motion, when applied to a joint between arm 330 and main body 340, may cause arm 330 to move through range of motion 328. Linear motion of outer housing 350 toward a distal end of main body 340 may cause arm 330 to rotate away from main body 340 within range of motion 328. Linear motion of outer housing 350 toward a proximal end of main body 340 may cause arm 330 to rotate toward main body 340 through range of motion 328. In embodiments, range of motion 328 may be greater than ninety degrees. For example, range of motion 328 may be at least one hundred-twenty degrees, at least one-hundred thirty-five degrees, or at least one-hundred fifty degrees. A first position of arm 330 may correspond to a first end of range of motion 328 in which arm 330 is proximate or against main body 340. One or more second positions for arm 330 may include other angular positions within range of motion 328 to which arm 330 may be rotated, including a position at an opposite end of range of motion 328 from a first end that corresponds to a first position of arm 330. A position of arm 330 may define an angle between axis 324 and axis 320 according to various aspects of the present disclosure.

Arm 330 may be limited from rotating beyond range of motion 328. At a first end of range of motion 328, arm 330 may physically contact main body 340. At an opposite end, one or more of hinge 346, hinge 348, or a physical size or shape of arm 330 relative to other components of electrical weapon 300 may prevent further rotation of arm 330. In embodiments, a limit of a range of motion 328 may also correspond to an operational limit (e.g., maximum travel, maximum force, etc.) of a source of motion coupled to a joint between arm 330 and main body 340. The operational limit of the source of motion may be a same limit for each arm to which the source of motion is coupled, such as both arms 310 and 330 in embodiments according to various aspects of the present disclosure.

In embodiments, elements of arm 330 may rotate with arm 330 through range of motion 328. A contact end of arm 330 may pivot through range of motion 328, as may electrode 332. An orientation of electrode 332, which may be perpendicular to extension axis 324, may also change throughout range of motion 328. For example, in a first position, electrode 332 and a surface of arm 330 on which electrode 332 is disposed may be perpendicular to axis 320. In a second position between ends of range of motion 328, an orientation of electrode 332 and a surface on which electrode 332 is disposed may be parallel to axis 320. In another second position at or proximate an end of range of motion 328, an orientation of electrode and a surface on which electrode 332 is disposed may be oriented to intersect with axis 320. In the other second position, an orientation of electrode 332 may further intersect an orientation of electrode 312 when arm 312 is disposed in a corresponding other second position. In accordance with an orientation of electrode 312 intersection an orientation of electrode 332, a target may be positioned between electrodes 312 and 332. As weapon 300 is positioned proximate the target, an orientation of arm 310 and arm 330 may encourage the target to contact or be positioned proximate to both electrode 312 and 332, thereby enabling a stimulus signal to be provided by electrodes 312 and 332. In this example, orientation of one or more of electrode 332 and a surface on which electrode 332 is disposed may be perpendicular to extension axis 324 of arm 330.

In embodiments, ranges of motion 326, 328 may be different ranges of motion. A position of arm 310 may not overlap or intersect with a position of arm 330 in accordance with the respective ranges of motion 326,328 of each arm 310, 330. Collectively, ranges of motion 326 and 328 may span at least one-hundred eighty degrees, at least two hundred forty degrees, or at least three hundred degrees in embodiments according to various aspects of the present disclosure. Ranges of motion 326 and 328 may be symmetrically positioned about axis 320. In other embodiments, ranges of motion 326, 328 may be different and/or symmetrically disposed about axis, such that one arm of arms 310,330 may extend to a different angle relative and rotation to a different second position as compared to the other arm 330,310.

In embodiments, an arm may include multiple electrodes positioned thereon. For example, an arm may include a first electrode, a second electrode, and a third electrode. At least one of the multiple electrodes may include a capacitive electrode. At least one of the multiple electrodes may include a contact electrode. The multiple electrodes may include different types of electrodes, configured to provide a stimulus signal in different manners. The multiple electrodes may include different shapes of electrodes, configured to provide a stimulus signal over different surface areas. In embodiments, each of the multiple electrodes on the arm may be provided in series in a single circuit on the arm. The multiple electrodes may be configured to receive a stimulus signal along a single channel among multiple channels for an electrical weapon. The multiple electrodes may be positioned on different surfaces of an arm, including surfaces and/or orientations in which the electrodes are oriented in same, perpendicular, or opposite directions.

In embodiments, a contact electrode may be configured to provide a single portion of a stimulus signal. The contact electrode may require another electrode in contact or placed proximate a target in order to transmit a stimulus signal through a target. The contact electrode may include a single conductor. The contact electrode may be electrically coupled to a portion of a stimulus signal. A portion of a stimulus signal to which a contact electrode may be electrically coupled may include one of a ground voltage portion, a negative voltage portion, and a positive voltage portion of a stimulus signal. In embodiments, limited voltage drop of a stimulus signal may occur over a contact electrode in series with other electrodes in a channel of an arm.

In embodiments, a capacitive electrode may be configured to provide multiple portions of a stimulus signal. The capacitive electrode may include multiple conductors. Accordingly, the capacitive electrode may provide a first portion of a stimulus signal from a first conductor of the capacitive electrode and another portion of a stimulus signal from a second conductor of the capacitive electrode. A conductor of the capacitive electrode may also provide a first portion of a stimulus signal and another electrode may provide another portion of the stimulus signal, wherein each of the conductor and other electrode are in contact or placed proximate a target in order to provide the stimulus signal. A first conductor of the capacitive electrode may be electrically coupled to one of a ground voltage portion and a negative voltage portion of a stimulus signal, while a second conductor may be electrically coupled to a positive voltage portion or a ground voltage portion of the stimulus signal, wherein only one or zero of the two electrodes may be coupled to the ground voltage portion of the stimulus signal. A stimulus signal may be conducted between conductors of a capacitive electrode via an electrical discharge in air between the conductors, corresponding to an ionization of the air between the conductors. In embodiments, a voltage drop of a stimulus signal between the conductors in the capacitive electrode may correspond to a voltage drop across the ionized air. A capacitive electrode may include multiple conductors that may only be electrically coupled by a stimulus signal via electrical discharge in air. In embodiments, the capacitive electrode may be configured to only conduct a stimulus signal through the capacitive electrode via an electrical path formed via ionization of air between pairs of conductors of the capacitive electrode. The stimulus signal may be selected to only enable transmission of current though electrical discharge in air, rather than one or more other materials or paths between conductors of the capacitive electrode.

In various embodiments, arm 310 may include a first electrode 312 and a second electrode 318. First electrode 312 may be a capacitive electrode. Second electrode 318 may be a contact electrode 318. Electrode 312 and electrode 318 may be positioned on different surfaces of arm 310. Electrode 312 and electrode 318 may be configured to contact or be placed proximate to a target in different directions relative to arm 310. In embodiments, a stimulus signal may be provided to a target via path comprising electrode 312, target tissue, and electrode 318. In embodiments, a stimulus signal may be provided to a target via a path comprising electrode 312, target tissue, and electrode 312, wherein different conductors of electrode 312 are included in the path.

Similarly, arm 330 may include a first electrode 332 and a second electrode 338. First electrode 332 may be a capacitive electrode. Second electrode 338 may be a contact electrode. Electrode 332 and electrode 338 may be positioned on different surfaces of arm 330. Electrode 332 and electrode 338 may be configured to contact or be placed proximate to a target in different directions relative to arm 330. In embodiments, a stimulus signal may be provided to a target via path comprising electrode 332, target tissue, and electrode 338. In embodiments, a stimulus signal may be provided to a target via a path comprising electrode 332, target tissue, and electrode 332. In embodiments, a stimulus signal may be provided between one of electrode 312 or 318 of arm 310 and one of electrode 332 and 338 of arm 330.

In embodiments, electrical weapon 300 may be configured in a closed or compact configuration in which one or more electrodes are configured to provide a stimulus signal over distances insufficient or unlikely to cause NMI. The distances may be less than six inches, less than four inches, or less than two inches. The distances may correspond to a distance equal or less than a distance of a longest length of a single electrode. A closed or compact configuration may correspond to a configuration of electrical weapon 100, with brief reference to FIG. 1.

In a compact configuration, each of arms 310 and 330 of electrical weapon 300 may be disposed in a respective first position. In the first position, each arm 310, 330 may be in contact or placed proximate main body 340. Each position may correspond an end of a range of motion 326,328 closest to central axis 320. In the first positions, a distance between electrodes 312 and 332 may be less than six inches, less than five inches, less than four inches, and less than three inches in length. The distance may correspond to a shortest distance between any conductor of electrode 312 closest to any conductor of electrode 332. In embodiments, a distance between electrodes 318 and 338 may similarly be less than less than six inches, less than five inches, less than four inches, and less than three inches in length. This distance may also correspond to a shortest distance between a conductor of electrode 318 and a conductor of electrode 338, wherein the conductor of each electrode 318, 338 is a conductor closest to the other electrode 338, 318. In embodiments, the distance between electrodes of different arms may be sufficient to prevent arcing between electrodes on different arms of the electrical weapon. For example, the distance between electrodes on different arms of electrical weapon 300 in a closed configuration of electrical weapon 300 may be greater than a distance between two or more conductors of one or more of electrodes 312 and 332.

In embodiments, one or more electrodes of an arm may be covered by a portion of main body 340, in a compact configuration of an electrical weapon, thus preventing the electrode from contacting or being placed proximate a target and preventing a stimulus signal from being provided by the electrode. For example, one or more of electrode 318 and electrode 338 may be physically covered (e.g., blocked, received by, etc.) a portion of main body 340 in the respective first position of each of arm 310 and arm 330. Orientations of electrodes on a same arm, including a direction in which the electrode may contact or be placed proximate a target relative to a main body of an electrical weapon, may also be opposite each other or otherwise non-overlapping, such that a likelihood of contacting a same target with different electrodes is substantially reduced. For example, electrode 312 and electrode 318 may be oriented in different directions in a compact configuration of electrical weapon 300, such that electrode 312 and electrode 318 are unlikely to both contact or be placed proximate a same target at a same time.

A compact configuration may enable an electrical weapon to be used in a first manner to provide a stimulus signal to a target. For example, the stimulus signal may be applied via a surface of an arm or main body along the arm or main body between a distal end and proximate end of the main body of the electrical weapon. The first manner of providing the stimulus signal may be useful in close quarters between a target and a user of electrical weapon. The first manner may not require adjustment of a position of the arm to apply the stimulus signal. The first manner may be useful when a housing of the electrical weapon is being used to physically defend or block a user of the electrical weapon from a target. The compact configuration may be useful when a user of the electrical weapon has assumed a defensive position. The stimulus signal may be provided in the compact configuration of the electrical weapon, even though a distance between electrodes may be insufficient or unlikely to cause NMI.

In embodiments, electrical weapon 300 may be configured in an open or expanded configuration in which one or more electrodes are configured to provide a stimulus signal over one or more distances sufficient or likely to cause NMI. The one or more distances may include one or more distances greater than six inches, greater than nine inches, or greater than twelve inches. The distances may correspond to a distance equal or greater than a longest length of a single electrode. For example, a single electrode may include a plurality of conductors and a distance over which an electrical weapon may provide a stimulus signal in an expanded configuration may be greater than a distance between a farthest apart pair of conductors of the electrode.

In an expanded configuration, each of arms 310 and 330 of electrical weapon 300 may be disposed in a respective second position. In the second position, each arm 310, 330 may be spaced apart from main body 340, except for a pivot end of each arm 310,330 coupled to main body 340 via a respective joint. Each second position may correspond an end of a range of motion 326, 328 away or farthest central axis 320. The end of each range of motion 326,328 may be opposite an end of each range of motion 326,328 closest to central axis 320. In the second position of each arm 310,330, a distance between electrodes 312 and 332 may be greater than six inches, greater than nine inches, greater than twelve inches, or greater than fifteen inches in length. The distance may correspond to a shortest distance between any conductor(s) of electrode 312 and any conductor(s) of electrode 332. For example, the distance may be a distance between a conductor of each electrode 313,332 closest to each pivot end of the respective arm 310,330. In embodiments, the distance may include a distance between a conductor of each electrode 313,332 closest to each contact end of the respective arm 310,330.

In embodiments, a distance between electrodes 318 and 338 in an expanded position may similarly be greater than six inches, greater than nine inches, greater than twelve inches, greater than eighteen inches, or greater than twenty-four inches in length. This distance may correspond to a shortest distance between a conductor of electrode 318 and a conductor of electrode 338, each conductor being the closest conductor to the other electrode. In an expanded configuration, a distance between a first and second electrode, such as electrodes 312,332, may be less than a distance between a third and fourth electrode, such as electrodes 332,338. In the expanded configuration, pairs of electrodes at or closer to contact ends of a pair of arms of an electrical weapon may be further apart than another pair of electrodes of the pair of arms positioned closer to pivot ends of the pair of arms.

An expanded configuration may include multiple pairs of electrodes disposed at a distance equal or greater than a distance sufficient to cause NMI. These pairs may include electrode 312 and 332. These pairs may also include electrode 318 and 338. In embodiments, the distance between electrode 312 and 338 may also be sufficient to cause NMI and the distance between electrode 322 and 318 may alternately or additionally be sufficient to cause NMI. Each distance may correspond to a distance between a conductor in each electrode that is closer to the other electrode in each pair. In embodiments, a distance between each and every pair of electrodes between a first arm and a second arm may be greater than a threshold distance likely to cause NMI upon application of a stimulus signal to a target over the distance. A distance between an electrode of a first arm and each electrode of two or more electrodes of a second arm may be greater than a threshold distance likely to cause NMI upon application of a stimulus signal to a target over the distance. Distances between each such pair of electrodes may be insufficient to cause NMI in a compact configuration of electrical weapon 300 as discussed above.

In an expanded configuration, an electrode may be able to provide a stimulus signal insufficient to cause NMI alone and absent a signal path through another electrode. For example, each of electrodes 312 and 332 may be able to provide a stimulus signal insufficient to cause NMI alone and absent a signal path through another electrode. These electrodes may be configured to deter or prevent a target from grabbing, striking or making other intended or undesired contact with electrical weapon 300. Such electrodes may also prepare a stimulus signal to be provided to a target over a distance sufficient to cause NMI upon a second electrode making contact or being placed proximate a target. Such electrodes may also enable a stimulus signal to continue to be provided during changes in contact or proximity of a second electrode to a target, including during movement or other relative changes in position between the target and an electrical weapon on which the electrodes are disposed.

In an expanded configuration, arms of an electrical weapon may be configured to surround or at least partially surround a target. In the expanded configuration of electrical weapon 300, arm 310 and 330 may be positioned with an angle less than one-hundred-eighty degrees between a surface on which electrode 312 is positioned and a surface on which electrode 332 is positioned. The angle between arms 310 and 330 may be less than one-hundred-fifty degrees, less than one-hundred-twenty degrees, less than ninety degrees, or less than sixty degrees. The angle may be acute or obtuse, thus configured to provide a region between arms 310 and 310 in which a target may be positioned and electrodes 312 and 332 may be configured to make contact or be placed proximate the target. Axis 320 may bisect this angle, such that half of the angle is disposed between axis 320 and axis 322 of arm 310 and the other half is disposed between axis 320 and axis 324 of arm 330. In accordance with such an angle and relative position between the two arms, surfaces of the arms 310 and/or 330 may be used to guide a respective electrode 312 and/or 332 toward a target as electrical weapon 300 is positioned closer to the target. The position of the two arms 310,330 may further ensure or aid maintaining contact between electrical weapon 300 and a target, including upon lateral movement of a target or movement of a target toward a distal end of electrical weapon 300.

In an expanded configuration, an orientation of an electrode may be configured to enable contact or proximate placement of the electrode to a target. The orientation may include a direction in which the electrode may contact or be placed proximate the target relative to a main body of an electrical weapon. The orientation may include a direction perpendicular to a surface of a conductor of the electrode. As discussed elsewhere herein, the orientation of an electrode may change in accordance with a position of an arm on which the electrode is located.

In embodiments, orientations of two or more electrodes may enable contact or proximate placement of the electrodes to same or different surfaces of a target. The same surface for two or more electrodes may include a substantially flat surface of the target, a contiguous surface of the target, or a surface of the target oriented in a same direction. The same surface may include a same surface for at least two of the two or more electrodes, enabling the at least two electrodes to be placed directly in contact or proximate the same surface. The different surfaces may include different surfaces for at least two of the two or more electrodes. The different surfaces may be disposed on different sides of a target, enabling the electrical weapon to be placed around or at least partially around a target.

In embodiments, orientations of the two or more electrodes may be toward a same direction and/or overlapping directions, such that a likelihood of contacting a same target with different electrodes is substantially increased. As illustrated in FIG. electrode 312 and electrode 332 may be oriented in overlapping directions in an expanded configuration of electrical weapon 300, such that electrode 312 and electrode 332 are likely to both contact or be placed proximate a same target at a same time. A shape of arms 310, 330 may funnel or otherwise direct a target toward electrodes 312 and 332, such that these electrodes may contact different sides or surfaces of the target. Further, electrode 318 and electrode 338 may be oriented in same directions in an expanded configuration of electrical weapon 300 as illustrated in FIG. 3, such that electrode 318 and electrode 338 are likely to both contact or be placed proximate a same target at a same time.

An expanded configuration enables an electrical weapon to be used in a second manner to provide a stimulus signal to a target. For example, a stimulus signal may provide a stimulus signal at a distal end of main body and/or beyond the distal end of the main body. The expanded configuration may allow the stimulus signal to be provided to a target at a maximum distance or range between a target and a user of the electrical weapon. The expanded configuration may enable the stimulus signal to be provided at a distance greater than a compact configuration of the electrical weapon. The second manner may include multiple different manners and directions of contact or proximity in which a stimulus signal sufficient to cause NMI may be provided from the electrical weapon to the target.

In embodiments, an electrode of an arm may be uncovered in an expanded configuration of an electrical weapon, thus enabling the uncovered electrode to contact or be placed proximate a target in the expanded configuration. For example, electrode 318 of arm 310 may be uncovered in an expanded configuration of an electrical weapon. The uncovered electrode may be covered when the arm is disposed in a first position and uncovered in one or more second positions of the arm. Each arm of an electrical weapon may include one or more uncovered electrodes. The uncovered electrode may include an electrode on a contact surface of the arm, such as electrode 318 on arm 310. The uncovered electrode may include an electrode on an opposite side and/or opposite surface relative to an electrode that remains uncovered in each of a first position and one or more second positions of the arm. For example, the uncovered electrode may include an electrode on an opposite side and/or opposite surface from a side and/or surface on which electrode 312 is disposed on arm 310.

In embodiments, an arm of an electrical weapon may further include another electrode. The other electrode may be a second electrode or a third electrode on the arm. The other electrode may be separate from each other electrode on the arm. The other electrode may include an electrode that is uncovered in an expanded configuration of the electrical weapon. The other electrode may include an electrode that is covered in a compact configuration of the electrical weapon. The other electrode may be positioned on a same or different surface of an arm relative to a surface on which another electrode of the arm is disposed. For example, the other electrode may be disposed on a surface opposite electrode 312 on arm 310 of electrical weapon 300, separate from electrode 312. In embodiments according to various aspects of the present disclosure, the other electrode may include one or more of a contact electrode and a capacitive electrode.

In embodiments, another electrode may be disposed at a different position along an axis of an arm of an electrical weapon relative to a first electrode on the arm. For example, another electrode may be positioned along axis 322 closer to a contact end of arm 310 relative to a position of electrode 312. Alternately, another electrode may be positioned along axis 322 closer to a pivot end of arm 310 relative to a position of electrode 312. In embodiments, the other electrode and electrode 312 may be disposed on different surfaces of arm 310 such that a position of a longest length of the other electrode may overlap a position of a longest length of electrode 312 along axis 322. In further embodiments, the other electrode and electrode 312 may not overlap linearly along axis 322, such that the other electrode and electrode 312 may be on same or different surfaces of arm 310 while each being configured to provide a stimulus signal. The other electrode may be configured to increase an overall surface area of electrical weapon 300 by which a stimulus signal may be provided, adding to a surface area provided by at least the first electrode of the arm.

Figure 4:
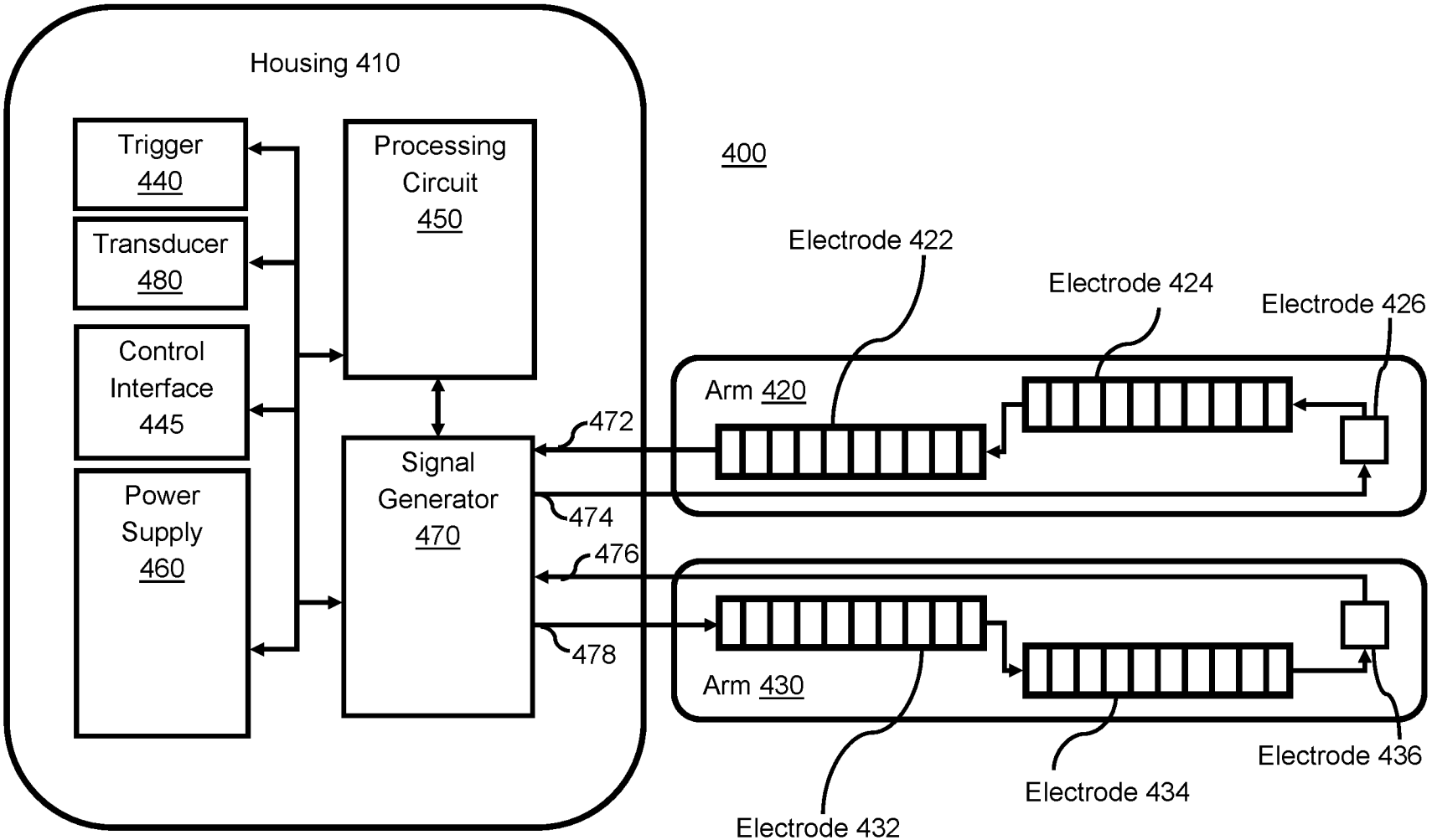
FIG. 4 illustrates a system for delivering a stimulus signal to a target in accordance with various embodiments.

In various embodiments, and with reference to FIG. 4, an electrical weapon 400 is disclosed. Electrical weapon 400 may be similar to, or have similar aspects and/or components with, the electrical weapons previously discussed herein. It should be understood by one skilled in the art that FIG. 4 is a schematic representation of electrical weapon 400, and one or more of the components of electrical weapon 400 may be located in any suitable position within, or external to, housing 410 or arms 420,430. Electrical weapon 400 may comprise a housing 410, a first arm 420, and a second arm 430. In embodiments, electrical weapon 400 may correspond to electrical weapon 100, 200, or 300 with brief reference to FIGS. 1-3.

Housing 410 may be configured to house various components of electrical weapon 400 configured to provide an electrical current to first arm 420, provide an electrical current to second arm 420, and otherwise aid in the operation of electrical weapon 400, as discussed further herein. Housing 410 and arms 420,430 may be configured as an electrified baton, though these components of electrical weapon 400 may comprise any other suitable shape and/or size in embodiments according to various aspects of the present disclosure. Housing 410 may include a main body of electrical weapon 400. Housing 410 may comprise one or more housings configured to house components of electrical weapon 400. For example, housing 410 may include an inner housing and outer housing in embodiments according to various aspects of the present disclosure.

In various embodiments, housing 410 may comprise various mechanical, electronic, and electrical components configured to aid in performing the functions of electrical weapon 400. For example, housing 410 may comprise one or more triggers 440, control interfaces 445, processing circuits 450, power supplies 460, signal generators 470, and/or transducers 480. In embodiments, housing 410 may correspond to main body 110 or main body 340 (with brief reference to FIGS. 1 and 3).

In various embodiments, trigger 440 be coupled to an outer surface of housing 410, and may be configured to move, slide, rotate, otherwise become physically depressed upon application of physical contact. For example, trigger 440 may be actuated by physical contact applied to trigger 440 in a direction perpendicular to a surface of housing 410 on which trigger 440 is positioned. Trigger 440 may comprise a mechanical or electromechanical switch, button, trigger, or the like. For example, trigger 440 may comprise a switch, a pushbutton, and/or any other suitable type of trigger. Trigger 440 may be mechanically and/or electronically coupled to processing circuit 450. In response to trigger 440 being activated (e.g., depressed, pushed, etc. by the user), processing circuit 450 may enable a stimulus signal to be provided to electrodes on one or more of arms 420,430 as discussed further herein. In embodiments, a user interface of electrical weapon 400 may include one or more triggers 440.

In various embodiments, power supply 460 may be configured to provide power to various components of electrical weapon 400. For example, power supply 460 may provide energy for operating the electronic and/or electrical components (e.g., parts, subsystems, circuits) of electrical weapon 400. Power supply 460 may provide electrical power. Providing electrical power may include providing a current at a voltage. Power supply 460 may be electrically coupled to processing circuit 450 and/or signal generator 470. In various embodiments, in response to control interface 445 or other control interface comprising electronic properties and/or components, power supply 460 may be electrically coupled to control interface 445 or the other control interface. Power supply 460 may be further electrically coupled to transducer 480. In various embodiments, in response to trigger 440 comprising electronic properties or components, power supply 460 may be electrically coupled to trigger 440. Power supply 460 may provide an electrical current at a voltage. Electrical power from power supply 460 may be provided as a direct current ("DC"). Electrical power from power supply 460 may be provided as an alternating current ("AC"). Power supply 460 may include a battery. The energy of power supply 460 may be renewable or exhaustible, and/or replaceable. For example, power supply 460 may comprise one or more rechargeable or disposable batteries. In various embodiments, the energy from power supply 460 may be converted from one form (e.g., electrical, magnetic, thermal) to another form to perform the functions of a system.

Power supply 460 may provide energy for performing the functions of electrical weapon 400. For example, power supply 460 may provide electrical current to signal generator 470 that is further provided through a target to impede locomotion of the target. Power supply 460 may provide the energy for a stimulus signal. Power supply 460 may provide the energy for other signals as discussed further herein.

In various embodiments, processing circuit 450 may comprise any circuitry, electrical components, electronic components, software, and/or the like configured to perform various operations and functions discussed herein. For example, processing circuit 450 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 450 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 450 may include data buses, output ports, input ports, timers, memory, arithmetic units, and/or the like.

Processing circuit 450 may be configured to provide and/or receive electrical signals whether digital and/or analog in form. Processing circuit 450 may provide and/or receive digital information via a data bus using any protocol. Processing circuit 450 may receive information, manipulate the received information, and provide the manipulated information. Processing circuit 450 may store information and retrieve stored information. Information received, stored, and/or manipulated by processing circuit 450 may be used to perform a function, control a function, and/or to perform an operation or execute a stored program.

Processing circuit 450 may control the operation and/or function of other circuits and/or components of electrical weapon 400. Processing circuit 450 may receive status information regarding the operation of other components, perform calculations with respect to the status information, and provide commands (e.g., instructions) to one or more other components. Processing circuit 450 may command another component to start operation, continue operation, alter operation, suspend operation, cease operation, or the like. Commands and/or status may be communicated between processing circuit 450 and other circuits and/or components via any type of bus (e.g., SPI bus) including any type of data/address bus.

In various embodiments, processing circuit 450 may be mechanically and/or electronically coupled to trigger 440. Processing circuit 450 may be configured to detect an activation, actuation, depression, input, etc. (collectively, an "activation event") of trigger 440. In response to detecting the activation event, processing circuit 450 may be configured to perform various operations and/or functions, as discussed further herein. Processing circuit 450 may also include a sensor (e.g., a trigger sensor) attached to trigger 440 and configured to detect an activation event of trigger 440. The sensor may comprise any suitable mechanical and/or electronic sensor capable of detecting an activation event in trigger 440 and reporting the activation event to processing circuit 450.

In various embodiments, processing circuit 450 may be mechanically and/or electronically coupled to control interface 445. Processing circuit 450 may be configured to detect an activation, actuation, depression, input, etc. (collectively, a "control event") of control interface 445. In response to detecting the control event, processing circuit 450 may be configured to perform various operations and/or functions, as discussed further herein. Processing circuit 450 may also include a sensor (e.g., a control sensor) attached to control interface 445 and configured to detect a control event of control interface 445. The sensor may comprise any suitable mechanical and/or electronic sensor capable of detecting a control event in control interface 445 and reporting the control event to processing circuit 550.

In various embodiments, processing circuit 450 may be electrically and/or electronically coupled to power supply 460. Processing circuit 450 may receive power from power supply 460. The power received from power supply 460 may be used by processing circuit 450 to receive signals, process signals, and transmit signals to various other components in electrical weapon 400. Processing circuit 450 may use power from power supply 460 to detect an activation event of trigger 440, a control event of control interface 445, or the like, and generate one or more control signals in response to the detected events. The control signal may be based on the control event and the activation event. The control signal may be an electrical signal.

In various embodiments, processing circuit 450 may be electrically and/or electronically coupled to signal generator 470. Processing circuit 450 may be configured to transmit or provide control signals to signal generator 470 in response to detecting an activation event of trigger 440. Multiple control signals may be provided from microprocessor 450 to signal generator 470 in series. In response to receiving the control signal, signal generator 470 may be configured to perform various functions and/or operations, as discussed further herein.

In various embodiments, control interface 445 may be configured to control selection of control modes in electrical weapon 400. Controlling selection of control modes in electrical weapon 400 may include disabling providing a stimulus signal to one or more arms 420,430 of electrical weapon 400 (e.g., a safety mode) and enabling providing a stimulus signal to one or more arms 420,430 of electrical weapon 400 (e.g., a stimulus mode) as discussed further herein. Control interface 445 may be located in any suitable location on housing 410. For example, control interface 445 may be coupled to an outer surface of housing 410. Control interface 445 may be coupled to an outer surface of housing 410 proximate trigger 440. Control interface 445 may be electrically, mechanically, and/or electronically coupled to processing circuit 450. In various embodiments, in response to control interface 445 comprising electronic properties or components, control interface 445 may be electrically coupled to power supply 460. Control interface 445 may receive power (e.g., electrical current) from power supply 460 to power the electronic properties or components. In embodiments, a user interface of electrical weapon 400 may include one or more control interfaces 445.

Control interface 445 may be electronically or mechanically coupled to trigger 440. For example, and as discussed further herein, control interface 445 may function as a safety. In response to control interface 445 being set to a "safety mode," electrical weapon 400 may be prevented from providing a stimulus signal in response to an activation of trigger 440. For example, control interface 445 may provide a signal (e.g., a control signal) to processing circuit 450 instructing processing circuit 450 to disable signal generator 470. In response to control interface 445 being set to a "stimulus mode," electrical weapon 400 may be enabled to provide a stimulus signal, including in response to an activation of trigger 440. For example, control interface 445 may provide a signal (e.g., a control signal) to processing circuit 450 instructing processing circuit 450 to enable signal generator 470. As a further example, control interface 445 may electronically or mechanically prohibit trigger 440 from activating (e.g., prevent or disable a user from depressing trigger 440) or enable trigger 440 to activate (e.g., permit or enable a user to depress trigger 440).

Control interface 445 may comprise one or more suitable electronic or mechanical components capable of enabling selection of control modes in electrical weapon 400. For example, control interface 445 may comprise a selector switch, a safety switch, a safety catch, a rotating switch, a selection switch, and/or any other suitable mechanical control switch. As a further example, control interface 445 may comprise a touch screen or similar electronic component.

In various embodiments, and with reference to FIG. 4, control interface 445 may enable selection of control modes comprising a safety mode and a stimulus mode. Although the present description describes each mode as a "safety mode," and an "stimulus mode," similar words and phrases, symbols, or the like may be used to impart similar functionalities. In response to a user selecting one of the control modes, control interface 445 may transmit instructions to processing circuit 450 based on the selection.

A safety mode may be configured to prohibit generation or providing of a stimulus signal from electrical weapon 400. For example, in response to a user selecting the safety mode, control interface 445 may transmit a safety mode instruction to processing circuit 450. In response to receiving the safety mode instruction, processing circuit 450 may prohibit generation or provision of a stimulus signal from signal generator 470. In embodiments, processing circuit 450 may disable signal generator 470 in a safety mode. Processing circuit 450 may prohibit providing the stimulus signal until a further instruction is received from control interface 445. As previously discussed, control interface 445 may interact with trigger 440 to prevent activation of trigger 440.

A stimulus mode may be configured to enable providing a stimulus signal from signal generator 470 to one or more arms 420,430, and one or more electrodes 422,424,426,432, 434, and 436 on arms 420,430 of electrical weapon 400. For example, in response to a user selecting the stimulus mode, control interface 445 may transmit a stimulus mode instruction to processing circuit 450. In response to receiving the stimulus mode instruction, processing circuit 450 may enable generation or provision of a stimulus signal from signal generator 470, including in response to an activation of trigger 440. In embodiments, processing circuit 450 may enable signal generator 470 in a stimulus mode. Processing circuit 450 may enable providing the stimulus signal until a further instruction is received from control interface 445. As previously discussed, control interface 445 may interact with trigger 440 to enable activation of trigger 440. For example, in response to trigger 440 being activated in the stimulus mode, processing circuit 450 may cause the generation of providing of a stimulus signal by signal generator 470.

In various embodiments, control interface 445 may be configured to control selection of configurations of electrical weapon 400. Control interface 445 may enable selection of configurations comprising a compact configuration and an expanded configuration. For example, control interface 445 may provide a signal (e.g., a control signal) to processing circuit 450 instructing processing circuit 450 to enable or disable a source of motion (not shown) for arms 420 and 430. The source of motion may include one or more of a linear actuator, rotatory actuator, servomotor, pump, piston, or other electromechanical actuator configured to provide a force to change a position of an arm of an electrical weapon. A first activation of control interface 445 may enable the source of motion to provide a force via a joint to move an arm to a second position. A second activation of control interface 445 may enable the source of motion to provide a force via a joint to move an arm to a first position. Processing circuit 445 may receive a control signal corresponding to an activation of control interface 445 and further provide a control signal to an actuator to cause the source of motion to apply, not apply, or selectively apply a force to an arm in accordance with the activation of control interface 445. In other embodiments, a source of motion for electrical weapon 400 may include a manual force provided by a user, such that a control signal from a control interface may not be required to change a position of an arm of electrical weapon 400. In embodiments, a user interface of electrical weapon 400 may not include a control interface 445.

In various embodiments, and with reference again to FIG. 4, signal generator 470 may be configured to receive one or more control signals from processing circuit 450. Signal generator 470 may provide a stimulus signal to arm 420 and arm 430 based on the control signals. Signal generator 470 may be electrically and/or electronically coupled to processing circuit 450 and/or one or more electrodes 422,424,426, 432, 434, and 436 in arms 420,430. Signal generator 470 may be electrically coupled to power supply 460. Signal generator 470 may use power received from power supply 460 to generate a stimulus signal. For example, signal generator 470 may receive an electrical signal from power supply 460 that has first current and voltage values. Signal generator 470 may transform the electrical signal into a stimulus signal having second current and voltage values. The transformed second current and/or the transformed second voltage values may be different from the first current and/or voltage values. The transformed second current and/or the transformed second voltage values may be the same as the first current and/or voltage values. Signal generator 470 may temporarily store power from power supply 460 and rely on the stored power entirely or in part to provide the stimulus signal. Signal generator 470 may also rely on received power from power supply 460 entirely or in part to provide the stimulus signal, without needing to temporarily store power.

Signal generator 470 may be controlled entirely or in part by processing circuit 450. In various embodiments, signal generator 470 and processing circuit 450 may be separate components (e.g., physically distinct and/or logically discrete). Signal generator 470 and processing circuit 450 may be a single component. For example, a control circuit within housing 410 may at least include signal generator 470 and processing circuit 450. The control circuit may also include other components and/or arrangements, including those that further integrate corresponding function of these elements into a single component or circuit, as well as those that further separate certain functions into separate components or circuits.

Signal generator 470 may be controlled by the control signals to generate a stimulus signal having a predetermined current value or values. For example, signal generator 470 may include a current source. The control signal may be received by signal generator 470 to activate the current source at a current value of the current source. An additional control signal may be received to decrease a current of the current source. For example, signal generator 470 may include a pulse width modification circuit coupled between a current source and an output of the control circuit. A second control signal may be received by signal generator 470 to activate the pulse width modification circuit, thereby decreasing a non-zero period of a signal generated by the current source and an overall current of a stimulus signal subsequently output by the control circuit. The pulse width modification circuit may be separate from a circuit of the current source or, alternatively, integrated within a circuit of the current source. Various other forms of signal generators 470 may alternatively or additionally be employed, including those that apply a voltage over one or more different resistances to generate signals with different currents. In various embodiments, signal generator 470 may include a high-voltage module configured to deliver an electrical current having a high voltage. In various embodiments, signal generator 470 may include a low-voltage module configured to deliver an electrical current having a lower voltage, such as, for example, 2,000 volts.

In embodiments, signal generator 470 may be configured to provide different stimulus signals in accordance with detected electrical coupling with a target. A first stimulus signal, comprising a voltage and/or current sufficient to cause electrical discharge in air between conductors of an electrode may be provided when the electrical coupling is not detected. A second stimulus signal, comprising a voltage and/or current sufficient to cause NMI may be provided when the electrical coupling is not detected. The second stimulus signal may have a lower voltage or current than the first stimulus signal. In embodiments, one or more pulses in the first stimulus signal may be different from one or more pulses in the second stimulus signal. In embodiments, the second stimulus signal may be applied through different combinations of electrodes than the first stimulus signal.

Responsive to receipt of a signal indicating activation of trigger 440 (e.g., an activation event), a control circuit provides a stimulus signal to arms 420, 430. For example, signal generator 470 may provide an electrical signal as a stimulus signal to arm 420 in response to receiving a control signal from processing circuit 450. Signal generator 470 may also provide an electrical signal as a second stimulus signal to arm 430 in response to receiving a control signal from processing circuit 450. The stimulus signal and the stimulus signal may concurrently be provided to arms 420, 430.

In various embodiments, a stimulus signal applied to arm 420 may be separate and distinct from a stimulus signal applied to arm 430. For example, a stimulus signal in electrical weapon 400 may be provided to a different circuit within arm 420, relative to a circuit to which a stimulus signal is provided to arm 430. Signal generator 470 may provide a first stimulus signal via connector 474 to arm 420 and a second stimulus signal to arm 430 via connector 478. Signal generator 470 may also provide a first stimulus signal via connector 472 to arm 420 and a second stimulus signal to arm 430 via connector 476.

In embodiments, providing a stimulus signal by signal generator may include providing a stimulus signal to each arm of an electrical weapon. Each stimulus signal for an arm may be generated by a same signal generator, such as signal generator 470 for arms 420 and 430. In various embodiments, a second, separate signal generator, component, or circuit (not shown) within housing 410 may be configured to generate a second stimulus signal. Signal generator 470 may also provide a ground signal path for arm 420 and arm 430, thereby completing a circuit for an electrical signal provided to each of arm 420 and arm 430 by signal generator 470. For example, a return path may be provided via connector 472 for arm 420 and connector 476 for arm 430. The ground signal path may also be provided to one or more arms 420 or 430 by other elements in housing 410, including power supply 460.

In various embodiments, a stimulus signal may include a first portion and a second portion configured to be transmitted through a given channel or circuit. The given channel may correspond to a signal path. The given channel may include a path through target tissue when one or more electrodes contact or are placed proximate the target. The first portion of a stimulus signal may include a positive voltage portion of a stimulus signal and a second portion of a stimulus signal may include a negative voltage portion of the stimulus signal. Collectively, the first portion and second portion may increase a voltage differential across the given channel or circuit to which the stimulus signal is provided, thereby increasing a current transmitted via the stimulus signal. The portions of the stimulus signal may be provided by different connectors of a signal generator. For example, a first connector 474 may provide a first portion of a first stimulus signal and a second connector 472 may provide a second portion of the first stimulus signal from the signal generator 470. In embodiments, a third connector 478 may provide a first portion of a second stimulus signal and a fourth connector 476 may provide a second portion of the second stimulus signal from the signal generator 470.

In various embodiments, arm 420 may include a first electrode 422, a second electrode 424, and a third electrode 426. Each electrode 422, 424, 426 may provide a signal path through which a stimulus signal may be transmitted. Each electrode 422, 424, 426 may be coupled in series. Each electrode 422, 424, 426 may be electrically coupled to receive a same stimulus signal. Electrode 422 may be coupled via a connector 472 to signal generator 470. Electrode 422 may also be coupled via electrodes 424 and 426 and connector 474 to signal generator 470. Electrode 426 may be coupled via a connector 474 to signal generator 470. Electrode 426 may also be coupled via electrodes 422 and 424 and connector 472 to signal generator 470. Electrode 424 may be coupled via electrode 422 to signal generator 470 and coupled via 426 to signal generator 470. In embodiments, electrodes 422, 424, 426 of arm 420 may be coupled to connectors 472, 474 via a high voltage rotating joint as discussed elsewhere herein. Each electrode 422, 424, 426 may be separate from each other electrode 426, 424, 422 on arm 420 and respectively include one or more separate conductors.

In various embodiments, arm 430 may include a first electrode 432, a second electrode 434, and a third electrode 436. Each electrode 432, 434, 436 may provide a signal path through which a stimulus signal may be transmitted. Each electrode 432, 434, 436 may be coupled in series. Each electrode 432, 434, 436 may be electrically coupled to receive a same stimulus signal. Electrode 432 may be coupled via a connector 478 to signal generator 470. Electrode 432 may also be coupled via electrodes 434 and 436 to signal generator 470. Electrode 436 may be coupled via a connector 476 to signal generator 470. Electrode 436 may also be coupled via electrodes 432 and 434 to signal generator 470. Electrode 434 may be coupled via electrode 432 to signal generator 470 and coupled via 436 to signal generator 470. In embodiments, electrodes 432, 434, 436 of arm 430 may be coupled to connectors 476, 478 via a high voltage rotating joint as discussed elsewhere herein. Each electrode 432, 434, 436 may be separate from each other electrode 436, 434, 432 on arm 430 and respectively include one or more separate conductors.

Electrode 422 may comprise a capacitive electrode. The capacitive electrode may comprise a first conductor coupled to signal generator 470 via connector 472. Electrode 422 may receive a second portion of a stimulus signal from connector 472. The capacitive electrode may comprise a second conductor coupled to a conductor of electrode 424. The capacitive electrode may include one or more intermediate conductors, which may each be connected to two other conductors of the electrode 422 via a respective electrical discharge in air. The one or more intermediate conductors may be disposed linearly between the first and second conductors of electrode 422. The one or more intermediate conductors may be disposed on an axis between the first and second conductors of electrode 422. The conductors of electrode 422 may be disposed along (e.g., parallel to) an axis of arm 420, such as an extension axis of arm 420. In embodiments, electrode 422 may correspond to electrode 130 or electrode 312 with brief reference to FIGS. 1 and 3.

Electrode 424 may comprise a capacitive electrode. The capacitive electrode may comprise a first conductor coupled to a conductor of electrode 422. The capacitive electrode may comprise a second conductor coupled to a conductor of electrode 426. The capacitive electrode may include one or more intermediate conductors, which may each be connected to two other conductors of electrode 424 via a respective electrical discharge in air. The one or more intermediate conductors may be disposed linearly between the first and second conductors of electrode 424. The one or more intermediate conductors may be disposed on an axis between the first and second conductors of electrode 424. The conductors of electrode 424 may be disposed along (e.g., parallel to) an axis of arm 420, such as an extension axis of arm 420. In embodiments, the conductors of electrode 424 may be disposed parallel to and/or along a same axis of arm 420 as electrode 422. In embodiments, the conductors of electrode 424 may be disposed parallel to and/or along an axis of electrode 422. In embodiments, electrode 424 may be disposed on a surface of arm 420 opposite a surface on which electrode 422 is disposed on arm 420.

Electrode 426 may comprise a contact electrode configured to provide a portion of a stimulus signal to a target. The contact electrode may comprise a single conductor through which a stimulus signal is coupled via a wired connection. Electrode 426 may receive a first portion of the stimulus signal from conductor 474.

In embodiments, arm 430 comprises electrodes 432, 434, 436. These electrodes 432, 434, 436 may correspond to, comprise same or similar respective features or properties of respective electrodes 422, 424, and 426 of arm 420. Electrodes 432 and 434 may each include a respective capacitive electrode and electrode 436 may include a contact electrode. Conductors of electrodes 432 and 434 may be disposed along and/or parallel to an axis or arm 430 and/or a common axis between electrode 432 and 434.

In embodiments, a stimulus signal may be coupled across a series of conductors of one arm of an electrical weapon in a manner different from which the stimulus signal is coupled across a series of conductor of another arm of the electrical weapon. The manner may be reversed, such that voltage drop across one series of conductors is opposite the voltage drop across the other series of electrodes. Each series of conductors may comprise a first conductor and a second conductor. Each conductor in a series of conductor may be provide in a same or different electrode. For example, a first conductor and second conductor may comprise different conductors in a capacitive electrode. Alternately, a first conductor may be provided in a first electrode and a second conductor of the series of conductors may be provided in a different electrode. In accordance with the different manner of coupling, a current of the stimulus signal may be provided in one direction across the one series of conductors and a second current of the stimulus signal may be provided in another, opposite direction across the other series of conductors. For example, a first conductor of electrode 432 may receive a first portion of a stimulus signal via connector 478 and a another conductor or electrode 432 may receive a second portion of the stimulus signal via connector 476 and a second conductor of electrode 436, opposite from an arrangement in which the first and second portions of stimulus signal may be received for arm 420 and a third conductor of electrode 422 and a fourth conductor of 426. In embodiments, such an arrangement may enable different portions of a stimulus signal from each arm 420,430 to be transferred via contact electrodes 426 and 436. For example, a conductor of electrode 426 may provide a first portion of a stimulus signal and a conductor of electrode 436 may provide a second portion of a stimulus signal upon contact or proximate placement of electrodes 426,436 to a target. Electrode 426 may receive a positive voltage portion of the stimulus signal from signal generator 470 and electrode 436 may receive a negative voltage portion of the stimulus signal from signal generator 470, thereby enabling current to be provided to a target via electrodes 426 and 436. Each series of conductor may receive both portions of a stimulus signal sufficient to provide the stimulus signal alone; however, the opposite manners in which two different series of conductors may further enable the stimulus signal to also be provided between the two different series of conductors, rather than a single series of conductors alone. In other embodiments, a manner in which portions of a respective stimulus signal from signal generator 470 may not be different between arms 420 and 430. Further, signal generator 470 may be operable to provide first and second portions of a stimulus signal to each of connectors 472, 474, 476, 478, such that the stimulus signal may be provided in a variety of different manners in accordance with a detected signal path between two or more of the connectors 472, 474, 476, and 478.

In embodiments, electrical weapon 400 may include one or more transducers 480. Transducer 480 may correspond to transducer 280 (with brief reference to FIG. 2). Transducer 480 may be coupled to receive power from one or more of power supply 460 and processing circuit 450. Transducer 480 may be controlled by processing circuit 450 and coupled to provide or receive one or more transducer signals from processing circuit 450. For example, transducer 480 may include a microphone and provide an audio signal to processing circuit 450. Transducer 480 may include a speaker be further configured to output an audio signal provided by processing circuit 450. Transducer 480 may include a camera and be further configured to provide a video signal to processing circuit 450. Processing circuit 450 may store a transducer signal received from transducer 480 and/or transmit the transducer signal to a computing device separate from electrical weapon 400. Processing circuit 450 may also provide a transducer signal to transducer 480 from a computer-readable medium and/or generated by processing circuit 450. Processing circuit 450 may also provide a transducer signal to transducer 480 received from a computing device separate from electrical weapon 400. In other embodiments, transducer 480 may include one or more electrodes by which a stimulus signal from signal generator 470 may be provided. For example, transducer 480 may include one of a capacitive electrode and a contact electrode. Transducer 480 may be coupled to an outer surface of housing 410 such that a signal may be received or provided from the transducer 480 to an environment in which electrical weapon 400 is used.

Figure 5:
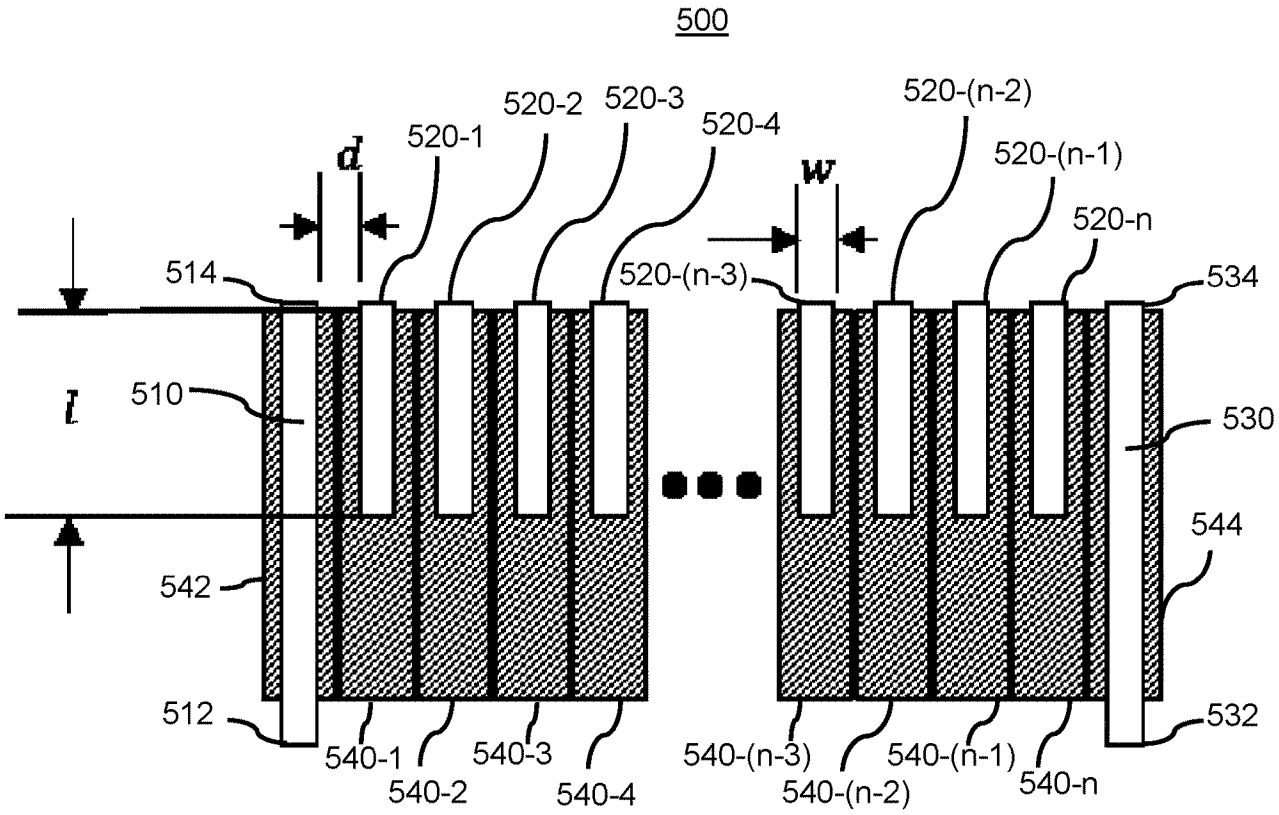
FIG. 5 illustrates an electrode array for an electrified baton in accordance with various embodiments.
Figure 6:
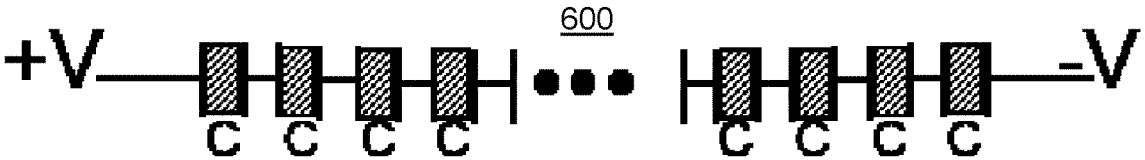
FIG. 6 illustrates an equivalent circuit for an electrode array in accordance with various embodiments.

In various embodiments, an electrical weapon may include an electrode array as illustrated in FIG. 5. The electrode array may include capacitive electrode 500. Capacitive electrode 500 may include physical elements corresponding to one or more elements illustrated in FIG. 5. An effective electrical circuit for an electrode array is illustrated in FIG. 6. Capacitive electrode 500 may correspond to each of one or more of electrode 422, electrode 424, electrode 432, electrode 434, electrode 312, or electrode 332 with brief reference to FIGS. 3 and 4.

Capacitive electrode 500 may be configured to distribute an area in which contact or being placed proximate to a target would deliver a stimulus signal sufficient to cause NMI. Capacitive electrode 500 may include a first conductor 510, one or more intermediate conductors 520, a second conductor 530. Capacitive electrode may further include one or more insulators 540, 542, and/or 544.

Each conductor 510,520, 530 may include an electrically conductive material configured to transmit an electrical charge. In embodiments, the material may include one or more of a wire, magnet wire, and a conductive metal element. In embodiments, at least one surface of the material of the conductor may be exposed to air, such that one or more electrical discharges through the air may be transmitted and/or received by the conductor. In embodiments, at least one surface of the material is further enclosed by an insulator. The at least one surface enclosed by the insulator may include one or more surfaces on one or more sides of the material. First conductor 510 and second conductor 530 may include at least one surface on at least one side of the conductor 510,530 enclosed by an insulator, while each intermediate conductor 520 may include at least two surfaces on at least two sides of the conductor 520 enclosed by an insulator. The at least two surfaces may include surfaces on opposite sides of the conductor 520. In embodiments, a side of the material of each intermediate conductor 520 opposite a side exposed to air may also be enclosed by an insulator.

In various embodiments, each conductor 510,520, 530 may include a high voltage conductor. The high voltage conductor may have a voltage rating of at least 1000 V. The high voltage conductor may safely and repeatedly carry a signal with a voltage greater than 1000 volts.

In embodiments, an intermediate conductor 520 may be ungrounded, while each of first conductor 510 and second conductor 530 may be coupled to a portion of a stimulus signal via a wired connection. In embodiments, a length of an intermediate conductor 520 corresponding to a longest dimension may be at least half an inch, at least three quarters of an inch, at least one inch, at least an inch and a half, or other lengths. In embodiments, a length of a conductor 520 corresponds to a capacitance of a capacitor including the conductor, such that an increase in the length increases a capacitance of the capacitor formed by the conductor. In embodiments, a longest dimension of each conductor 510, 520, 530 is positioned parallel to each other in capacitive electrode 500. In embodiments, intermediate conductor 520 may include at least three intermediate conductors, at least five intermediate conductors, at least ten intermediate conductors, at least twenty intermediate conductors, or at least thirty intermediate connectors.

Insulator 540 may include a non-electrically conductive material configured to resist transfer of an electrical charge. In embodiments, insulator 540 may include a polymer or plastic material, such as polytetrafluoroethylene (PTFE). Insulator 540 may include a tube or tubing in which a conductor is disposed. Insulator 540 may be extruded or otherwise physically coupled with a conductor, such as one of conductors 510, 520, and 530. In embodiments, insulator 540 may comprise a solid material. Insulator 540 may further include one or more dielectric materials disposed on one or more sides of an associated conductor. Insulator 540 may further include one or more layers of one or more dielectric materials on one or more sides of an associated conductor. In embodiments, an electrical resistance of insulator 540 may be greater or substantially greater than an electrical resistance of air. In embodiments, insulator 540 may comprise at least two materials, wherein a first material is disposed along a length of a conductor and a second material is disposed along a width of a conductor on a side of the conductor adjacent the length. In embodiments, insulator 542 and/or 544 may correspond to an insulator such as insulator 540, though disposed with conductor 510 and/or conductor 530 respectively, rather than an intermediate conductor 520.

In embodiments, a wire may comprise a conductor and one or more layers of an insulator. For example, a first wire may comprise conductor 510 and insulator 542. An adjacent conductor 524-1 and associated insulator 540-1 may be included in a second wire, separate from a first wire. Second conductor 530 and associated insulator 544 may comprise a third wire, separate from a first wire and second wire of capacitive electrode 500. Each conductor 520 and respective conductor 540 pair, such as conductor 520-2 and insulator 540-2; conductor 520-3 and insulator 540-3; conductor 520-4 and insulator 540-4; conductor 520-($n$−3) and insulator 540-($n$−3); conductor 520-($n$−2) and insulator 540-($n$−2); conductor 520-($n$−1) and insulator 540-($n$−1); and conductor 520-*n* and insulator 540-*n* may be included in a separate wire from another conductor and insulator pair. In embodiments, each wire may be physically coupled to an adjacent wire, though electrically isolated via a dielectric material associated with one or more insulators of the adjacent wires. In embodiments, a wire of a conductor and insulator pair may include one of a 12 gauge wire, 16 gauge wire, and a 20 gauge wire, though other gauges, including combinations of gauges may be used in embodiments according to various aspects of the present disclosure. In embodiments, a two or more insulators, such as insulator 540-1 and 540-2 may be integrated into a single insulator and may comprise a single dielectric material.

In embodiments, a length of an insulator may be equal or greater than a length of an adjacent conductor. The length may be equal or greater than a length of each conductor adjacent to the conductor. The length of each of the conductor and an adjacent insulator may include a longest dimension of each of the conductor and insulator.

As illustrated in FIG. 5, first conductor 510 and paired insulator 542 may be disposed at a first end of capacitive electrode 500. First conductor 510 may receive a first portion of a stimulus signal. The stimulus signal may be received at a first end 512 of conductor 510, though other portions of conductor 510 may receive such a signal in embodiments according to various aspects of the present disclosure. A second end 514 of conductor 510 may be exposed to air. The second end 514 may be uncovered by insulator 542. An intermediate conductor 520-1 may be physically separated from conductor 510 via insulator 542 and insulator 540-1, preventing direct electrical coupling of the stimulus signal received by conductor 510 to intermediate conductor 520-1. Particularly, a current of the stimulus signal may be prevented from being transferred to conductor 520-1 via one or more of insulator 542 and 540-1. However, a charge on conductor 510 from the stimulus signal may be transferred to conductor 520-1 via mutual capacitance between conductor 510 and conductor 520-1. A second charge corresponding to the charge of conductor 510 from the stimulus signal may build up on a length of intermediate conductor 520-1 adjacent conductor 510, such that each elongated side of conductors 510,520-1 forms aside of a parallel plate capacitor. The charge between conductor 510 and conductor 520-1, absent additional charge, may be insufficient to cause a current to flow between insulators 542,540-1 or in air between conductor 510 and 520-1.

Upon transferring a charge from conductor 510 to conductor 520-1, a charge may be further transferred to other intermediate conductors 520 of capacitive electrode 500. As noted elsewhere herein, intermediate conductors 520 may be ungrounded. Responsive to the charges on each side of insulators 542,540-1, a third charge builds up on a side of conductor 520-1 opposite conductor 510. The side may be an elongated side of conductor 520-1, closer to conductor 520-2 than to conductor 510. The intermediate conductor 520-1 may have charges on each of opposite sides a conductive material from which conductor 520-1 is formed. In turn, the third charge may further cause a fourth charge to build up on a side of conductor 520-2 closest to conductor 520-1 and separated by insulators 540-1,540-2. The third and fourth charge, absent an additional voltage difference, may remain insufficient to cause current associated with a stimulus signal to be transferred via air between exposed surfaces of conductors 520-1,520-2 or a dielectric material between conductors 520-1,520-2 associated with one or more of insulators 520-1,520-2. This transfer of charge may continue to adjacent intermediate conductors 520-3, 520-4, through each conductor of capacitive electrode 500 to conductors 520-*n* and second conductor 530.

In embodiments, a second charge may be transferred across capacitive electrode 500 from an end of the capacitive electrode 500 associated with a second conductor 530. As illustrated in FIG. 5, second conductor 530 and paired insulator 544 may be disposed at a second end of capacitive electrode 500. Second conductor 530 may receive a second portion of a stimulus signal, different from a first portion of the stimulus signal. In embodiments, the first portion and second portion may have different polarities, such that a combined voltage difference between the two portions is greater than a voltage difference between ground and an individual portion of the stimulus signal. The second portion of the stimulus signal may be received at a first end 532 of conductor 530, though other portions of conductor 530 may receive such a signal in embodiments according to various aspects of the present disclosure. A second end 534 of conductor 530 may be exposed to air, uncovered by insulator 544. An intermediate conductor 520-*n* may be physically separated from conductor 530 via insulator 544 and insulator 540-*n*, preventing direct coupling of the stimulus signal received by conductor 530 to intermediate conductor 520-1. Particularly, a current of the stimulus signal may be prevented from being transferred to conductor 520-*n* via one or more of insulator 544 and 540-*n*. However, a charge on conductor 530 from the stimulus signal may be transferred to conductor 520-*n* via mutual capacitance between conductor 530 and conductor 520-*n*. A second charge corresponding to a charge of conductor 530 from the stimulus signal may be generated on a length of intermediate conductor 520-*n* adjacent conductor 530, such that each elongated side of conductors 530,520-*n* forms a side of a parallel plate capacitor. The charge between conductor 530 and conductor 520-*n*, absent additional charge, may be insufficient to cause a current to flow between insulators 544,540-*n* or in air between conductor 530 and 520-*n* via surfaces of conductors 530,520-*n* exposed to the air.

Upon transferring a charge associated with a second portion of a stimulus signal from conductor 530 to conductor 520-*n*, a charge is further transferred to other intermediate conductors 520 of capacitive electrode 500. Responsive to the charges on either side of insulators 543,540-*n*, a third charge may be generated or built up on a side of conductor 520-*n* opposite conductor 530. In turn, this third charge may further cause a fourth charge to build up on a side of conductor 520-($n$−1) closest to conductor 520-*n* and separated by insulators 540-*n* and 540-($n$−1). The third and fourth charge, absent an additional voltage difference, may remain insufficient to cause current associated with a stimulus signal to be transferred via air between exposed surfaces of conductors 520-*n*, 520-($n$−1) or a dielectric material between conductors 520-*n*, 520-($n$−1) associated with one or more of insulators 520-*n*, 520-($n$−1). This transfer of charge may continue to adjacent intermediate conductors 520-($n$−2), 520-($n$−3), 520-($n$−4) of capacitive electrode 500, including through conductors 520-1 and first conductor 510.

An equivalent circuit for an electrode array is illustrated in FIG. 6. The electrode array may comprise a capacitive electrode. Equivalent circuit 600 may be an equivalent circuit for capacitive electrode 500 with reference to FIG. 5. In accordance with a charge from a stimulus signal and a lack of direct electrical coupling, each pair of adjacent conductors forms a parallel plate capacitor. Particularly, each side of a length of a conductor forms one side of the parallel plate capacitor. Capacitance C of an individual parallel plate capacitor may be determined by:

$$C = \frac{(l * w)}{d} * \varepsilon_0 * \varepsilon_R$$

where l=a length of a conductor, d=a distance between two conductors, w=a width of a conductor, E.sub0=dielectric constant of free space, and E.subR=dielectric constant of dielectric material between conductors. A series of conductors, such as shown for conductors 510,520,530 of capacitive electrode 500 in FIG. 5 thus forms an electrical circuit equivalent to a sequence of capacitors connected in series as illustrated in FIG. 6. Each intermediate conductor of an electrode array may provide a parallel plate of different capacitor. Each intermediate conductor of an electrode array may provide two parallel plates of different capacitors. As illustrated, each end of the series may be driven with a different portion of a stimulus signal, wherein a first end may be driven with a positive voltage portion (+V) and a second end may be driven with a negative voltage portion (−V). In combination, these voltage portions +V, −V may form a voltage differential needed to arc between capacitors, resulting in an electrical discharge in air and a visible arc between each plate of a given parallel plate capacitor.

Upon application of different portions of a stimulus signal from different ends of capacitive electrode 500, a pair of adjacent conductors of capacitive electrode 500 may receive a charge associated with each portion of the stimulus signal. The different portions may be applied concurrently or simultaneously to capacitive electrode 500. In embodiments, a voltage difference associated with voltage difference between a first portion of the stimulus signal and a second portion of the stimulus signal may be sufficient to cause an electrical breakdown of air between the conductors. The breakdown may include ionization of air between the conductors, enabling an electrical discharge through the air and electrical coupling of current through the air. The ionization may generate plasma that emits visible light, wherein the visible light along a path of the electrical discharge provides a visible arc.

In embodiments, charge from each portion of a stimulus signal may enable an electrical discharge and associated visible arc between each pair of adjacent conductors of the electrode array of FIG. 5. A charge associated with a first portion on one side of a conductor may be sufficient to cause an electrical discharge in air when a second charge associated with aa second portion of a stimulus signal is provided on an adjacent conductor. When a stimulus signal is provided to capacitive electrode, conductor 510 may conduct the stimulus signal via electrical discharge in air to conductor 520-1. Conductor 520-1 may conduct the stimulus signal via electrical discharge in air to conductor 520-2. Conductor 520-2 may conduct the stimulus signal via electrical discharge in air to conductor 520-3. This transfer of the stimulus signal may continue through each pair of conductors, including the second conductor 530, wherein conductor **520-*n* may conduct the stimulus signal via electrical discharge in air to second conductor 530. Each intermediate conductor 520 may conduct the stimulus signal toward first conductor 510 via at least one first electrical discharge and associated first visible arc. Each intermediate conductor 520 may also conduct the stimulus signal toward second conductor 530 via at least one second electrical discharge and associated second visible arc. Each intermediate conductor 520 may conduct a first and second visible arc via a same surface of the conductor 520 exposed to air. One or more intermediate conductors 520 may include an exposed surface adjacent an exposed surface at a first end 514 of first conductor 510 and an exposed surface adjacent an exposed surface at a first end 534 of second conductor 530. Collectively, a series of electrical discharges and visible arcs may be generated along an entire series of exposed surfaces of capacitive electrode 500. A provided stimulus signal may cause the series of electrical discharges and visible arcs to continue sequentially through first conductor 510 to second conductor 530**.

In other embodiments, one of a first portion or second portion of a stimulus signal may be electrically grounded. In these embodiments, a voltage difference between the other portion of the stimulus signal and ground may be sufficient to cause electrical discharge in air of the stimulus signal for a capacitive electrode.

In embodiments, first conductor 510, intermediate conductor(s) 520, and second conductor 530 may be disposed along an axis in order to maximize a length along which a stimulus signal may be provided to a target, as well as maximize a length along which a series of electrical arcs may be provided to present a visual warning to a target. In embodiments, the one or more intermediate conductors 520 may be disposed in line between first conductor 510 and second conductor 530. First conductor 510, intermediate conductor(s) 520, and second conductor 530 may be disposed along a length of at least three inches, at least six inches, at least nine inches, or at least twelve inches in embodiments according to various aspects of the present disclosure. In embodiments, a series of visible arcs may be provided along a distance of the capacitive electrode 500 of at least two inches, at least four inches, at least six inches, at least eight inches, at least ten inches, at least twelve inches, or at least sixteen inches.

In embodiments, a spacing or other physical separation may not be provided between two conductors and an insulator between the two conductors, such that the insulator physically couples the two conductors. The insulator may fill an area between the two conductors. The insulator may be physically and directly connected each of the conductors on opposite sides of the insulator. The insulator may preclude air or other gaseous layer from being disposed in a direct path between conductors in which the insulator is disposed. In embodiments, a distance between the two conductors filled by the insulator may be less than 0.05 inches, less than 0.10 inches, less than 0.250 inches, less than 0.50 inches, or less than 0.75 inches.

In other embodiments, a spacing between two adjacent conductors and/or adjacent insulators of the conductors may be provided. The spacing may be less than an eighth of an inch, less than a quarter of an inch, less than half an inch, less than three quarters of an inch, or less than an inch, wherein a voltage difference between the two conductors from a stimulus signal may remain sufficient to cause an electrical discharge in air and a visible electrical arc between the two conductors. The spacing between a first conductor or insulator and a second conductor or insulator may be filled with air, though the presence of the first and/or second insulator may cause an electrical discharge between the first and second conductors in a path other than a path directly between the conductors in which the first and/or second insulator is disposed. In embodiments, a length, spacing, and other property between two conductors in a capacitive electrode may be same length, spacing, or other property as another pair of conductors in the capacitive electrode, including all pairs of adjacent conductors. Such parity may provide a uniform path or at least partially uniform path via which a stimulus signal across the capacitive electrode may be conducted.

In embodiments, a stimulus signal may be conducted across capacitive electrode 500 in a signal path formed by a breakdown of air between each conductor in the absence of a target either in contact with capacitive electrode 500 or placed proximate capacitive electrode 500. Upon encountering a target, a stimulus signal provided to capacitive electrode 500 may be conducted through a signal path within tissue of the target, rather than one or more electrical discharges between conductors of capacitive electrode 500. In accordance with a length of capacitive electrode 500, a signal path through the target may be sufficient or insufficient to cause NMI.

In embodiments, an electrical weapon according to various aspects of the present disclosure may not include an electrified baton. For example, a main body of the electrical weapon may not be elongated and/or may exclude one or more handle portions, including all handle portions. Further, the electrical weapon may not be configured to be carried by a user, including by a hand or hands of a single user. Alternate embodiments of the electrical weapon may be stationary. Alternate embodiments may also be portable, but may rely on an alternate manner of movement, aside from being manually transported or positioned by a user.

In various embodiments, an electrode array for an electrified baton is provided. The array may comprise a first conductor configured to receive a stimulus signal. The array may comprise a second conductor. The array may comprise at least one intermediate conductor positioned along a linear axis between the first conductor and the second conductor. The at least one intermediate conductor may be configured to provide the stimulus signal from the first conductor to the second conductor via an electrical discharge in air between the first conductor and the at least one intermediate conductor and between the at least one intermediate conductor and the second conductor. The at least one intermediate conductor may include at least three ungrounded conductors. The first conductor may be positioned at least three inches away from the second conductor. The at least one intermediate conductor may comprise a plurality of conductors positioned along a distance of at least three inches along the linear axis. A first dielectric material may be positioned between the first conductor and the at least one intermediate conductor and a second dielectric material may be positioned between the at least one intermediate conductor and the second conductor.

In various embodiments, an electrical weapon is provided. The electrical weapon may comprise a first conductor and a second conductor. The electrical weapon may comprise a third conductor and a fourth conductor. The electrical weapon may comprise a signal generator configured to provide a stimulus signal having a first portion and a second portion. The first conductor may be positioned on a first portion of the electrical weapon. The third conductor may be positioned on a second portion of the electrical weapon, symmetrical with respect to a position of the first conductor. The second conductor may be positioned on the first portion of the electrical weapon. The fourth conductor may be positioned on the second portion of the electrical weapon, symmetrical with respect to a position of the second conductor. The first conductor and the fourth conductor may be coupled to the first portion of the stimulus signal from the signal generator. The second conductor and the third conductor may be coupled to the second portion of the stimulus signal from the signal generator. The electrical weapon may comprise a first capacitive electrode comprising the first conductor. The electrical weapon may comprise a second capacitive electrode comprising the third conductor. The first portion of the stimulus signal may comprise a high voltage portion of the stimulus signal. The second portion of the stimulus signal may comprise a low voltage portion of the stimulus signal. The first portion of the electrical weapon may comprise one or more of a first arm or a first housing. The second portion of the electrical weapon may comprise one or more of a second arm or a second housing, different from the first arm and the first housing.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An electrical weapon for applying a stimulus signal to a target, comprising:

a signal generator configured to generate the stimulus signal;

a shaft;

a first arm pivotably coupled to the shaft;

a first electrode positioned on the first arm; and a second electrode positioned on the first arm, wherein:

the first electrode and the second electrode are electrically coupled to the signal generator to receive the stimulus signal;

the first electrode receives a first portion of the stimulus signal, the first portion of the stimulus signal comprising at least one of a first positive voltage, a first negative voltage, or a first polarity and the first electrode associated with a first signal path for the first portion of the stimulus signal; and the second electrode receives a second portion of the stimulus signal different from the first portion of the stimulus signal, the second portion of the stimulus signal comprising at least one of a second positive voltage, a second negative voltage, or a second polarity and the second electrode is associated with a second signal path for the second portion of the stimulus signal.

2. The electrical weapon of claim 1, further comprising a second arm pivotably coupled to the shaft and a third electrode electrically coupled to the signal generator, wherein the third electrode is positioned on the second arm.

3. The electrical weapon of claim 2, wherein the second arm further includes a fourth electrode electrically coupled to the signal generator.

4. The electrical weapon of claim 2, wherein:

the first electrode is positioned at a first end of the first arm opposite a second end of the first arm by which the first arm is pivotably coupled to the shaft; and the third electrode is positioned at a first end of the second arm opposite a second end of the second arm by which the second arm is pivotably coupled to the shaft.

5. The electrical weapon of claim 2, wherein the first arm is configured to rotate to a first position of the first arm and the second arm is configured to rotate to a first position of the second arm, and wherein the first electrode is spaced apart from the third electrode by a first distance of at least six inches when the first arm is rotated to the first position of the first arm and the second arm is rotated to the first position of the second arm.

6. The electrical weapon of claim 2, wherein the first arm is configured to rotate to a second position of the first arm and the second arm is configured to rotate to a second position of the second arm, and wherein the first electrode is spaced apart from the third electrode by a second distance of less than four inches when the first arm is rotated to the second position of the first arm and the second arm is rotated to the second position of the second arm.

7. The electrical weapon of claim 1, further comprising a joint configured to rotate the first arm between a first position relative to the shaft and a second position relative to the shaft, wherein a second distance between the shaft and the first electrode is greater in the second position than a first distance between the shaft and the first electrode in the first position.

8. The electrical weapon of claim 7, wherein the signal generator is configured to provide the stimulus signal to the first electrode and the second electrode when the first arm is rotated to the first position and when the first arm is rotated to the second position.

9. The electrical weapon of claim 7, wherein the joint comprises:

a first hinge coupling the first arm to a first housing of the shaft; and a second hinge coupling the first arm to a second housing of the shaft, such that movement of the second housing relative to the first housing causes the first arm to rotate relative to the second housing.

10. The electrical weapon of claim 9, wherein the second housing is configured to move linearly relative to the first housing and the first hinge and the second hinge are configured to translate the linear movement into rotational motion of the first arm relative to the second housing.

11. The electrical weapon of claim 1, wherein the first electrode includes an electrode array, the electrode array comprising:

a first conductor coupled to the signal generator;

a second conductor coupled to the signal generator; and at least one intermediate conductor positioned between the first conductor and the second conductor, wherein the signal generator is configured to provide the stimulus signal to the at least one intermediate conductor via the first conductor and the second conductor.

12. The electrical weapon of claim 11, wherein the electrode array is disposed along an axis coplanar with a central axis of the shaft.

13. The electrical weapon of claim 1, further comprising a third electrode positioned on one of the shaft and the first arm.

14. The electrical weapon of claim 1, wherein the stimulus signal is generated by the signal generator based at least on one or more control signals received by the signal generator.

15. An electrified baton, comprising:

an elongated housing including a distal end opposite a proximal end;

a first arm, the first arm including:

a first electrode, wherein the first electrode includes an electrode array comprising:

a first conductor;

a second conductor; and at least one intermediate conductor positioned between the first conductor and the second conductor, wherein the at least one intermediate conductor is configured to electrically couple a stimulus signal via an electrical discharge in air to each of the first conductor and the second conductor; and a first pivot end opposite a first contact end, wherein the first pivot end is rotationally coupled to the distal end of the elongated housing, thereby enabling the first electrode to rotate between a first position of the first arm and a second position of the first arm; and a signal generator configured to provide the stimulus signal via the first electrode, the stimulus signal generated by the signal generator based at least on a control signal received by the signal generator.

16. The electrified baton of claim 15, wherein the first electrode is positioned at the first contact end of the first arm.

17. The electrified baton of claim 15, further comprising a handle disposed at the proximal end of the elongated housing.

18. The electrified baton of claim 15, further comprising a second arm, the second arm including:

a second electrode; and a second pivot end opposite a second contact end, wherein the second pivot end of the second arm is rotationally coupled to the distal end of the elongated housing, thereby enabling the second electrode to rotate between a first position of the second arm and a second position of the second arm.

19. An electrode array for an electrified baton, comprising:

a first conductor configured to receive a stimulus signal;

a second conductor; and at least one intermediate conductor positioned along a linear axis between the first conductor and the second conductor, wherein the at least one intermediate conductor is configured to provide the stimulus signal from the first conductor to the second conductor via an electrical discharge in air between the first conductor and the at least one intermediate conductor and between the at least one intermediate conductor and the second conductor.

* * * * *